US012364908B2

(12) United States Patent
Burnett et al.

(10) Patent No.: US 12,364,908 B2
(45) **Date of Patent: *Jul. 22, 2025**

(54) AERODYNAMIC GOLF CLUB HEAD

(71) Applicant: Taylor Made Golf Company, Inc., Carlsbad, CA (US)

(72) Inventors: Michael Scott Burnett, McKinney, TX (US); Jeffrey J. Albertsen, Plano, TX (US); Marc Schmidt, Dallas, TX (US)

(73) Assignee: TAYLOR MADE GOLF COMPANY, INC., Carlsbad, CA (US)

( * ) Notice: Subject to any disclaimer, the term of this patent is extended or adjusted under 35 U.S.C. 154(b) by 244 days.

This patent is subject to a terminal disclaimer.

(21) Appl. No.: 18/207,276

(22) Filed: Jun. 8, 2023

(65) Prior Publication Data

US 2023/0338790 A1 Oct. 26, 2023

Related U.S. Application Data

(63) Continuation of application No. 17/485,977, filed on Sep. 27, 2021, now Pat. No. 11,707,652, which is a continuation of application No. 16/707,774, filed on Dec. 9, 2019, now Pat. No. 11,130,026, which is a continuation of application No. 16/105,001, filed on Aug. 20, 2018, now Pat. No. 10,500,451, which is a continuation of application No. 15/603,605, filed on May 24, 2017, now Pat. No. 10,052,531, which is a continuation of application No. 15/012,880, filed on (Continued)

(51) Int. Cl.
*A63B 53/04* (2015.01)
*A63B 60/00* (2015.01)

(52) U.S. Cl.
CPC ..... *A63B 53/0466* (2013.01); *A63B 53/0408* (2020.08); *A63B 53/0412* (2020.08); *A63B 53/0437* (2020.08); *A63B 60/006* (2020.08); *A63B 2225/01* (2013.01)

(58) Field of Classification Search
CPC ..... A63B 53/0466; A63B 53/0408; A63B 53/0412; A63B 53/0437; A63B 60/006; A63B 2225/01
See application file for complete search history.

(56) References Cited

U.S. PATENT DOCUMENTS 1,526,438 A 2/1925 Scott
1,541,126 A 6/1925 Dunn
(Continued)

FOREIGN PATENT DOCUMENTS

EP 0446935 9/1991
JP H06190088 7/1994
(Continued)

OTHER PUBLICATIONS

International Searching Authority (USPTO), International Search Report and Written Opinion for International Application No. PCT/US 09/49742, mailed Aug. 27, 2009, 11 pages.
(Continued)

*Primary Examiner* — Michael D Dennis
(74) *Attorney, Agent, or Firm* — Dawsey Co., LPA; David J. Dawsey

(57) ABSTRACT

An aerodynamic golf club head having body attributes that impart beneficial aerodynamic properties.

34 Claims, 17 Drawing Sheets

Related U.S. Application Data

Feb. 2, 2016, now Pat. No. 9,682,294, which is a continuation of application No. 14/260,328, filed on Apr. 24, 2014, now Pat. No. 9,278,266, which is a continuation of application No. 14/069,503, filed on Nov. 1, 2013, now Pat. No. 8,734,269, which is a continuation of application No. 13/969,670, filed on Aug. 19, 2013, now Pat. No. 8,602,909, which is a continuation of application No. 13/670,703, filed on Nov. 7, 2012, now Pat. No. 8,550,936, which is a continuation of application No. 13/304,863, filed on Nov. 28, 2011, now abandoned, which is a continuation of application No. 12/367,839, filed on Feb. 9, 2009, now Pat. No. 8,083,609.

(60) Provisional application No. 61/080,892, filed on Jul. 15, 2008, provisional application No. 61/101,919, filed on Oct. 1, 2008.

(56) References Cited

U.S. PATENT DOCUMENTS 2,083,189 A 6/1937 Crooker
2,460,435 A 2/1949 Schaffer
3,085,804 A 4/1963 Pieper
3,166,320 A 1/1965 Onions
3,266,805 A 8/1966 Bulla
3,468,544 A 9/1969 Antonious
3,637,218 A 1/1972 Carlino
3,893,672 A 7/1975 Schonher
3,941,390 A 3/1976 Hussey
3,985,363 A 10/1976 Jepson et al.
3,997,170 A 12/1976 Goldberg
4,043,563 A 8/1977 Churchward
4,065,133 A 12/1977 Gordos
4,077,633 A 3/1978 Studen
4,139,196 A 2/1979 Riley
4,147,349 A 4/1979 Jeghers
4,165,076 A 8/1979 Cella
4,193,601 A 3/1980 Reid, Jr. et al.
D256,709 S 9/1980 Reid, Jr. et al.
4,247,105 A 1/1981 Jeghers
D265,112 S 6/1982 Lyons
4,431,192 A 2/1984 Stuff, Jr.
4,432,549 A 2/1984 Zebelean
4,471,961 A 9/1984 Masghati et al.
4,527,799 A 7/1985 Solheim
4,592,552 A 6/1986 Garber
4,754,974 A 7/1988 Kobayashi
4,787,636 A 11/1988 Honma
4,811,950 A 3/1989 Kobayashi
4,881,739 A 11/1989 Garcia
4,895,367 A 1/1990 Kajita et al.
4,919,428 A 4/1990 Perkins
5,000,454 A 3/1991 Soda
5,054,784 A 10/1991 Collins
5,092,599 A 3/1992 Okumoto et al.
5,116,054 A 5/1992 Johnson
5,120,061 A 6/1992 Tsuchida et al.
5,190,289 A * 3/1993 Nagai ..... A63B 60/00 473/327
5,193,810 A 3/1993 Antonious
5,193,811 A 3/1993 Okumoto et al.
5,219,408 A 6/1993 Sun
5,221,086 A 6/1993 Antonious
5,255,919 A 10/1993 Johnson
5,301,944 A 4/1994 Koehler
5,318,297 A 6/1994 Davis et al.
D349,543 S 8/1994 MacDougall
5,340,106 A 8/1994 Ravaris
5,435,558 A 7/1995 Iriarte
5,482,280 A 1/1996 Yamawaki
5,499,814 A 3/1996 Lu
5,501,459 A 3/1996 Endo
5,511,786 A 4/1996 Antonious
5,518,243 A 5/1996 Redman
5,547,427 A 8/1996 Rigal et al.
5,558,332 A 9/1996 Cook
D375,130 S 10/1996 Hlinka et al.
D378,770 S 4/1997 Hlinka et al.
5,632,695 A 5/1997 Hlinka et al.
5,676,606 A 10/1997 Schaeffer et al.
5,695,412 A 12/1997 Cook
5,700,208 A 12/1997 Nelms
5,720,674 A 2/1998 Galy
5,759,114 A 6/1998 Bluto et al.
5,785,608 A 7/1998 Collins
5,785,609 A 7/1998 Sheets
5,797,807 A 8/1998 Moore
D397,750 S 9/1998 Frazetta
RE35,931 E 10/1998 Schroder et al.
D401,650 S 11/1998 Burrows
5,851,160 A 12/1998 Rugge et al.
5,876,293 A 3/1999 Musty
5,885,166 A 3/1999 Shiraishi
5,890,971 A 4/1999 Shiraishi
5,935,020 A 8/1999 Stites et al.
5,954,595 A 9/1999 Antonious
5,967,905 A 10/1999 Nakahara et al.
6,001,029 A 12/1999 Kobayashi
6,033,319 A 3/2000 Farrar
6,074,308 A 6/2000 Domas
6,083,115 A 7/2000 King
6,093,113 A 7/2000 Mertens
6,123,627 A 9/2000 Antonious
6,139,445 A 10/2000 Werner et al.
6,162,132 A 12/2000 Yoneyama
6,168,537 B1 1/2001 Ezawa
6,248,025 B1 6/2001 Murphy et al.
6,332,848 B1 12/2001 Long et al.
6,344,002 B1 2/2002 Kajita
6,402,639 B1 6/2002 Iwata et al.
6,458,042 B1 10/2002 Chen
6,464,598 B1 10/2002 Miller
6,471,604 B2 10/2002 Hocknell et al.
6,491,592 B2 12/2002 Cackett et al.
6,530,847 B1 3/2003 Antonious
6,565,452 B2 5/2003 Helmstetter et al.
6,575,845 B2 6/2003 Galloway et al.
6,582,323 B2 6/2003 Soracco et al.
6,592,466 B2 7/2003 Helmstetter et al.
6,607,452 B2 8/2003 Helmstetter et al.
D482,420 S 11/2003 Burrows
6,645,086 B1 11/2003 Chen
6,648,773 B1 11/2003 Evans
6,663,504 B2 12/2003 Hocknell et al.
6,669,578 B1 12/2003 Evans
6,676,536 B1 1/2004 Jacobson
6,723,002 B1 4/2004 Barlow
6,739,982 B2 5/2004 Murphy et al.
6,739,983 B2 5/2004 Helmstetter et al.
6,758,763 B2 7/2004 Murphy et al.
6,773,359 B1 8/2004 Lee
6,776,723 B2 8/2004 Bliss et al.
D501,903 S 2/2005 Tanaka
6,855,068 B2 2/2005 Antonious
6,860,818 B2 3/2005 Mahaffey et al.
6,860,824 B2 3/2005 Evans
6,875,129 B2 4/2005 Erickson et al.
6,881,159 B2 4/2005 Galloway et al.
6,890,267 B2 5/2005 Mahaffey et al.
6,926,619 B2 8/2005 Helmstetter et al.
6,929,565 B2 8/2005 Nakahara et al.
6,939,247 B1 9/2005 Schweigert et al.
6,955,612 B2 10/2005 Lu
6,988,960 B2 1/2006 Mahaffey et al.
6,991,558 B2 1/2006 Beach et al.
D515,643 S 2/2006 Oritz
6,994,636 B2 2/2006 Hocknell et al.
6,994,637 B2 2/2006 Murphy et al.
7,004,849 B2 2/2006 Cameron
7,025,692 B2 4/2006 Erickson et al.
7,025,695 B2 4/2006 Mitsuba

(56) References Cited

U.S. PATENT DOCUMENTS

| | | | |
|---|---|---|---|
| D522,601 | S | 6/2006 | Schweigert |
| 7,066,835 | B2 | 6/2006 | Evans et al. |
| 7,070,517 | B2 | 7/2006 | Cackett et al. |
| 7,086,962 | B2 | 8/2006 | Galloway et al. |
| 7,097,573 | B2 | 8/2006 | Erickson et al. |
| 7,118,493 | B2 | 10/2006 | Galloway |
| 7,121,957 | B2 | 10/2006 | Hocknell et al. |
| 7,125,344 | B2 | 10/2006 | Hocknell et al. |
| 7,128,661 | B2 | 10/2006 | Soracco et al. |
| 7,128,664 | B2 | 10/2006 | Onoda et al. |
| 7,144,333 | B2 | 12/2006 | Murphy et al. |
| 7,163,470 | B2 | 1/2007 | Galloway et al. |
| 7,166,038 | B2 | 1/2007 | Williams et al. |
| 7,169,058 | B1 | 1/2007 | Fagan |
| D537,495 | S | 2/2007 | Schweigert |
| 7,175,541 | B2 | 2/2007 | Lo |
| 7,189,165 | B2 | 3/2007 | Yamamoto |
| D543,600 | S | 5/2007 | Oldknow |
| D544,939 | S | 6/2007 | Radcliffe et al. |
| 7,229,362 | B2 | 6/2007 | Tavares |
| D549,792 | S | 8/2007 | Parise |
| 7,252,599 | B2 | 8/2007 | Hasegawa |
| 7,258,625 | B2 | 8/2007 | Kawaguchi et al. |
| 7,258,630 | B2 | 8/2007 | Erickson et al. |
| 7,258,631 | B2 | 8/2007 | Galloway et al. |
| 7,273,419 | B2 | 9/2007 | Evans et al. |
| D552,198 | S | 10/2007 | Schweigert |
| D554,720 | S | 11/2007 | Barez et al. |
| 7,291,074 | B2 | 11/2007 | Kouno et al. |
| 7,291,075 | B2 | 11/2007 | Williams et al. |
| 7,294,064 | B2 | 11/2007 | Tsurumaki et al. |
| 7,306,527 | B2 | 12/2007 | Williams et al. |
| 7,311,614 | B2 | 12/2007 | Kumamoto |
| D564,611 | S | 3/2008 | Llewellyn |
| 7,338,390 | B2 | 3/2008 | Lindsay |
| 7,344,452 | B2 | 3/2008 | Imamoto et al. |
| 7,371,191 | B2 | 5/2008 | Sugimoto |
| 7,377,860 | B2 | 5/2008 | Breier et al. |
| 7,390,266 | B2 | 6/2008 | Gwon |
| 7,402,113 | B2 | 7/2008 | Mori et al. |
| 7,413,520 | B1 | 8/2008 | Hocknell et al. |
| 7,416,496 | B2 | 8/2008 | Galloway et al. |
| 7,431,667 | B2 | 10/2008 | Vincent et al. |
| 7,435,190 | B2 | 10/2008 | Sugimoto |
| 7,452,286 | B2 | 11/2008 | Lin et al. |
| 7,462,109 | B2 | 12/2008 | Erickson et al. |
| 7,470,201 | B2 | 12/2008 | Nakahara et al. |
| 7,476,161 | B2 | 1/2009 | Williams et al. |
| 7,481,720 | B2 | 1/2009 | Tavares |
| D589,103 | S | 3/2009 | Kohno |
| 7,497,789 | B2 | 3/2009 | Burnett et al. |
| 7,503,854 | B2 | 3/2009 | Galloway et al. |
| 7,524,249 | B2 | 4/2009 | Breier et al. |
| 7,549,935 | B2 | 6/2009 | Foster et al. |
| 7,607,991 | B2 | 10/2009 | Sorenson |
| 7,628,713 | B2 | 12/2009 | Tavares |
| 7,632,193 | B2 | 12/2009 | Thielen |
| 7,637,822 | B2 | 12/2009 | Foster et al. |
| 7,658,686 | B2 | 2/2010 | Soracco |
| 7,674,187 | B2 | 3/2010 | Cackett et al. |
| 7,674,189 | B2 | 3/2010 | Beach et al. |
| 7,674,190 | B2 | 3/2010 | Galloway et al. |
| 7,691,008 | B2 | 4/2010 | Oyama |
| 7,731,603 | B2 | 6/2010 | Beach et al. |
| 7,749,097 | B2 | 7/2010 | Foster et al. |
| 7,758,454 | B2 | 7/2010 | Burnett et al. |
| D622,338 | S | 8/2010 | Kohno |
| D622,795 | S | 8/2010 | Furutate |
| 7,766,765 | B2 | 8/2010 | Oyama |
| 7,771,291 | B1 | 8/2010 | Willett et al. |
| 7,785,212 | B2 | 8/2010 | Lukasiewicz, Jr. et al. |
| 7,803,065 | B2 | 9/2010 | Breier et al. |
| 7,811,178 | B2 | 10/2010 | Davis |
| 7,846,038 | B2 | 12/2010 | Foster et al. |
| 7,927,229 | B2 | 4/2011 | Jertson et al. |
| 7,931,546 | B2 | 4/2011 | Bennett et al. |
| 7,934,998 | B2 | 5/2011 | Yokota |
| 7,938,740 | B2 | 5/2011 | Breier et al. |
| 7,980,964 | B2 | 7/2011 | Soracco |
| 7,993,216 | B2 | 8/2011 | Lee |
| 8,007,371 | B2 | 8/2011 | Breier et al. |
| 8,012,038 | B1 | 9/2011 | Beach et al. |
| 8,012,039 | B2 | 9/2011 | Greaney et al. |
| 8,038,545 | B2 | 10/2011 | Soracco |
| 8,043,167 | B2 | 10/2011 | Boyd et al. |
| 8,062,151 | B2 | 11/2011 | Boyd et al. |
| 8,083,609 | B2 | 12/2011 | Burnett et al. |
| 8,088,021 | B2 | 1/2012 | Albertsen et al. |
| 8,100,781 | B2 | 1/2012 | Burnett et al. |
| 8,133,135 | B2 | 3/2012 | Stites et al. |
| 8,147,354 | B2 | 4/2012 | Hartwell et al. |
| 8,167,739 | B2 | 5/2012 | Lukasiewicz, Jr. et al. |
| 8,187,115 | B2 | 5/2012 | Bennett et al. |
| 8,187,119 | B2 | 5/2012 | Rae et al. |
| 8,216,087 | B2 | 7/2012 | Breier et al. |
| 8,221,260 | B2 | 7/2012 | Stites et al. |
| 8,226,499 | B2 | 7/2012 | Soracco |
| 8,235,844 | B2 | 8/2012 | Albertsen et al. |
| 8,303,433 | B2 | 11/2012 | Roach et al. |
| 8,337,326 | B2 | 12/2012 | Lukasiewicz, Jr. et al. |
| 8,353,786 | B2 | 1/2013 | Beach et al. |
| 8,409,032 | B2 | 4/2013 | Myrhum et al. |
| 8,419,569 | B2 | 4/2013 | Bennett et al. |
| 8,425,827 | B2 | 4/2013 | Lee |
| 8,435,134 | B2 | 5/2013 | Tang et al. |
| 8,460,592 | B2 | 6/2013 | Breier et al. |
| D686,679 | S | 7/2013 | Greensmith et al. |
| 8,475,292 | B2 | 7/2013 | Rahrig et al. |
| 8,496,544 | B2 | 7/2013 | Curtis et al. |
| 8,506,421 | B2 | 8/2013 | Stites et al. |
| 8,523,705 | B2 | 9/2013 | Breier et al. |
| 8,529,368 | B2 | 9/2013 | Rice et al. |
| D692,077 | S | 10/2013 | Greensmith et al. |
| 8,550,935 | B2 | 10/2013 | Stites et al. |
| D696,366 | S | 12/2013 | Milo et al. |
| D696,367 | S | 12/2013 | Taylor et al. |
| D697,152 | S | 1/2014 | Harbert et al. |
| 8,622,847 | B2 | 1/2014 | Beach et al. |
| 8,663,029 | B2 | 3/2014 | Beach et al. |
| 8,678,946 | B2 | 3/2014 | Boyd et al. |
| 8,715,109 | B2 | 5/2014 | Bennett et al. |
| 8,747,252 | B2 | 6/2014 | Lukasiewicz, Jr. et al. |
| 8,784,232 | B2 | 7/2014 | Jertson et al. |
| 8,834,289 | B2 | 9/2014 | de la Cruz et al. |
| 8,834,290 | B2 | 9/2014 | Bezilla et al. |
| 8,834,294 | B1 | 9/2014 | Seluga et al. |
| 8,894,508 | B2 | 11/2014 | Myrhum et al. |
| 8,938,871 | B2 | 1/2015 | Roach et al. |
| 8,986,133 | B2 | 3/2015 | Bennett et al. |
| 9,044,653 | B2 | 6/2015 | Wahl et al. |
| 9,205,311 | B2 | 12/2015 | Stokke |
| 9,308,423 | B1 | 4/2016 | Tang et al. |
| 9,320,949 | B2 | 4/2016 | Golden et al. |
| 9,393,471 | B2 | 7/2016 | Beno et al. |
| 9,421,438 | B2 | 8/2016 | Beno et al. |
| 9,440,123 | B2 | 9/2016 | Beno et al. |
| 9,457,245 | B2 | 10/2016 | Lee |
| 9,474,946 | B2 | 10/2016 | Bennett et al. |
| 9,498,688 | B2 | 11/2016 | Galvan et al. |
| 9,504,889 | B2 | 11/2016 | Mitzel et al. |
| 9,616,301 | B2 | 4/2017 | Clausen et al. |
| 9,636,559 | B2 | 5/2017 | de la Cruz et al. |
| 9,682,299 | B2 | 6/2017 | Tang et al. |
| 9,776,053 | B2 | 10/2017 | Burnett et al. |
| 9,821,198 | B2 | 11/2017 | Stokke |
| 9,839,819 | B2 | 12/2017 | Mizutani et al. |
| 9,855,474 | B2 | 1/2018 | Beno et al. |
| 9,901,794 | B2 | 2/2018 | Beno et al. |
| 9,908,013 | B2 | 3/2018 | Hettinger et al. |
| 10,004,958 | B2 | 6/2018 | Tang et al. |
| 10,076,689 | B2 | 9/2018 | de la Cruz et al. |
| 10,076,694 | B2 | 9/2018 | Galvan et al. |
| 10,130,855 | B2 | 11/2018 | Stokke |
| 10,155,144 | B2 | 12/2018 | Lee |

(56) References Cited

U.S. PATENT DOCUMENTS

| | | | | |
|---|---|---|---|---|
| 10,213,663 | B2 | 2/2019 | Goudarzi et al. | |
| 10,245,481 | B1 | 4/2019 | Cleghorn | |
| 10,286,265 | B2 | 5/2019 | Tsunashima et al. | |
| 2002/0183130 | A1 | 12/2002 | Pacinella | |
| 2002/0183134 | A1 | 12/2002 | Allen et al. | |
| 2003/0083151 | A1 | 5/2003 | Nakahara et al. | |
| 2003/0114239 | A1 | 6/2003 | Mase | |
| 2003/0220154 | A1 | 11/2003 | Anelli | |
| 2004/0097299 | A1* | 5/2004 | Soracco | A63B 53/0466 473/345 |
| 2004/0138002 | A1 | 7/2004 | Murray | |
| 2004/0157678 | A1 | 8/2004 | Kohno | |
| 2004/0162156 | A1 | 8/2004 | Kohno | |
| 2004/0192463 | A1 | 9/2004 | Tsurumaki et al. | |
| 2005/0009622 | A1 | 1/2005 | Antonious | |
| 2005/0059508 | A1 | 3/2005 | Burnett et al. | |
| 2006/0009305 | A1 | 1/2006 | Lindsay | |
| 2006/0094535 | A1 | 5/2006 | Cameron | |
| 2006/0100028 | A1 | 5/2006 | Kuo | |
| 2006/0116218 | A1 | 6/2006 | Burnett et al. | |
| 2006/0258481 | A1 | 11/2006 | Oyama | |
| 2006/0281581 | A1 | 12/2006 | Yamamoto | |
| 2007/0054751 | A1 | 3/2007 | Breier | |
| 2007/0105657 | A1 | 5/2007 | Hirano | |
| 2007/0275792 | A1 | 11/2007 | Horacek et al. | |
| 2008/0039234 | A1 | 2/2008 | Williams et al. | |
| 2008/0132356 | A1* | 6/2008 | Chao | A63B 53/0466 473/345 |
| 2008/0146374 | A1 | 6/2008 | Beach et al. | |
| 2008/0171610 | A1 | 7/2008 | Shin | |
| 2008/0188320 | A1 | 8/2008 | Kamatari | |
| 2009/0069114 | A1 | 3/2009 | Foster et al. | |
| 2009/0088271 | A1 | 4/2009 | Beach | |
| 2009/0124411 | A1 | 5/2009 | Rae et al. | |
| 2009/0137338 | A1 | 5/2009 | Kajita | |
| 2009/0149275 | A1 | 6/2009 | Rae et al. | |
| 2009/0149276 | A1 | 6/2009 | Golden | |
| 2009/0170632 | A1 | 7/2009 | Beach et al. | |
| 2009/0191980 | A1 | 7/2009 | Greaney et al. | |
| 2009/0286611 | A1 | 11/2009 | Beach et al. | |
| 2010/0016095 | A1 | 1/2010 | Burnett et al. | |
| 2010/0016097 | A1 | 1/2010 | Albertsen | |
| 2011/0014992 | A1 | 1/2011 | Morrissey | |
| 2012/0071267 | A1 | 3/2012 | Burnett et al. | |
| 2012/0071268 | A1 | 3/2012 | Albertsen et al. | |
| 2012/0172146 | A1 | 7/2012 | Greaney et al. | |
| 2012/0316007 | A1 | 12/2012 | Burnett et al. | |
| 2013/0079172 | A1 | 3/2013 | Roger et al. | |
| 2013/0123040 | A1 | 5/2013 | Willett et al. | |
| 2014/0155193 | A1 | 6/2014 | Takechi | |
| 2014/0256461 | A1 | 9/2014 | Beach et al. | |
| 2017/0312591 | A1 | 11/2017 | Saso | |
| 2017/0319917 | A1 | 11/2017 | Henrikson et al. | |
| 2018/0361216 | A1 | 12/2018 | Galvan et al. | |
| 2019/0070469 | A1 | 3/2019 | Lee | |

FOREIGN PATENT DOCUMENTS

| | | | |
|---|---|---|---|
| JP | 07112041 | | 5/1995 |
| JP | H10225538 | | 8/1998 |
| JP | H10263118 | | 10/1998 |
| JP | H11114102 | | 4/1999 |
| JP | H11155982 | | 6/1999 |
| JP | 4703085 | | 5/2000 |
| JP | 2000202075 | A | 7/2000 |
| JP | 3070587 | U | 8/2000 |
| JP | 2000245876 | A | 9/2000 |
| JP | 2001212272 | A | 8/2001 |
| JP | 2002119627 | A | 8/2001 |
| JP | 2002-052099 | | 2/2002 |
| JP | 2002136625 | | 5/2002 |
| JP | 2003135632 | | 5/2003 |
| JP | 2003199848 | | 7/2003 |
| JP | 2003210621 | | 7/2003 |
| JP | 2003524487 | | 8/2003 |
| JP | 2003320061 | | 11/2003 |
| JP | 2004174224 | | 6/2004 |
| JP | 2004232397 | | 8/2004 |
| JP | 2004261451 | | 9/2004 |
| JP | 2004265992 | | 9/2004 |
| JP | 2004271516 | | 9/2004 |
| JP | 2004313762 | | 11/2004 |
| JP | 2004351054 | | 12/2004 |
| JP | 2004351173 | | 12/2004 |
| JP | 2005073736 | | 3/2005 |
| JP | 2005111172 | | 4/2005 |
| JP | 2005137494 | | 6/2005 |
| JP | 2005137788 | | 6/2005 |
| JP | 2005137940 | | 6/2005 |
| JP | 4138378 | | 7/2005 |
| JP | 3719924 | | 11/2005 |
| JP | 2006006975 | | 1/2006 |
| JP | 3744814 | | 2/2006 |
| JP | 3762906 | | 4/2006 |
| JP | 3762906 | B2 | 4/2006 |
| JP | 4500296 | | 10/2006 |
| JP | 3895571 | | 3/2007 |
| JP | 2007136068 | A | 6/2007 |
| JP | 3953299 | | 8/2007 |
| JP | 3963999 | B2 | 8/2007 |
| JP | 2007229002 | A | 9/2007 |
| JP | 2007275552 | A | 10/2007 |
| JP | 4033035 | B2 | 1/2008 |
| JP | 4047682 | B2 | 2/2008 |
| JP | 4052113 | | 2/2008 |
| JP | 4054316 | | 2/2008 |
| JP | 4097666 | | 6/2008 |
| JP | 4212616 | | 1/2009 |
| JP | 2009000292 | A | 1/2009 |
| JP | 4222118 | B2 | 2/2009 |
| JP | 4222119 | B2 | 2/2009 |
| JP | 4241779 | | 3/2009 |
| JP | 4287769 | | 7/2009 |
| JP | 4291834 | | 7/2009 |
| JP | 4299844 | | 7/2009 |
| JP | 4355245 | | 8/2009 |
| JP | 4326559 | | 9/2009 |
| JP | 4326562 | | 9/2009 |
| JP | 4365676 | | 11/2009 |
| JP | 4365871 | | 11/2009 |
| JP | 4398880 | | 1/2010 |
| JP | 4403084 | | 1/2010 |
| JP | 4410594 | | 1/2010 |
| JP | 4410606 | | 2/2010 |
| JP | 4441462 | | 3/2010 |
| JP | 4451797 | | 4/2010 |
| JP | 4528281 | | 8/2010 |
| JP | 4563062 | | 10/2010 |
| JP | 5467717 | | 12/2010 |
| JP | 3165282 | | 1/2011 |
| JP | 4632342 | | 2/2011 |
| JP | 4634828 | | 2/2011 |
| JP | 5223844 | | 5/2011 |
| JP | 4741388 | | 8/2011 |
| JP | 4758177 | | 8/2011 |
| JP | 4758178 | | 8/2011 |
| JP | 4783579 | | 9/2011 |
| JP | 4786889 | | 10/2011 |
| JP | 5542147 | | 4/2012 |
| JP | 4944830 | | 6/2012 |
| JP | 5601669 | | 6/2012 |
| JP | 4993471 | | 8/2012 |
| JP | 4993481 | | 8/2012 |
| JP | 5007332 | | 8/2012 |
| JP | 5037445 | | 9/2012 |
| JP | 5037446 | | 9/2012 |
| JP | 5075143 | | 11/2012 |
| JP | 5086884 | | 11/2012 |
| JP | 5102084 | | 12/2012 |
| JP | 5106503 | | 12/2012 |
| JP | 5107404 | | 12/2012 |
| JP | 5583717 | | 2/2013 |
| JP | 5174129 | | 4/2013 |

(56) References Cited

FOREIGN PATENT DOCUMENTS

| | | |
|---|---|---|
| JP | 5181052 | 4/2013 |
| JP | 5185992 | 4/2013 |
| JP | 5238628 | 7/2013 |
| JP | 5249257 | 7/2013 |
| JP | 5264899 | 8/2013 |
| JP | 5280914 | 9/2013 |
| JP | 5280975 | 9/2013 |
| JP | 5324992 | 10/2013 |
| JP | 5341993 | 11/2013 |
| JP | 5342393 | 11/2013 |
| JP | 5349006 | 11/2013 |
| JP | 5359782 | 12/2013 |
| JP | 5374108 | 12/2013 |
| JP | 5377299 | 12/2013 |
| JP | 5952655 | 1/2014 |
| JP | 5152431 | 2/2014 |
| JP | 5421147 | 2/2014 |
| JP | 5427598 | 2/2014 |
| JP | 5451187 | 3/2014 |
| JP | 5601726 | 10/2014 |
| JP | 5637864 | 12/2014 |
| JP | 5671507 | 2/2015 |
| JP | 5690766 | 3/2015 |
| JP | 5785893 | 9/2015 |
| JP | 5785895 | 9/2015 |
| JP | 5795919 | 10/2015 |
| JP | 5823121 | 11/2015 |
| JP | 5823122 | 11/2015 |
| JP | 5886595 | 3/2016 |
| JP | 5886652 | 3/2016 |
| JP | 5996573 | 9/2016 |
| JP | 6002713 | 10/2016 |
| JP | 6011044 | 10/2016 |
| JP | 6074924 | 2/2017 |
| JP | 6082366 | 2/2017 |
| JP | 6476226 | 2/2019 |
| WO | 2005009543 | 2/2005 |

OTHER PUBLICATIONS

Excerpts from Golf Digest; magazine; Feb. 2004; Article entitled: "The Hot List", cover page from magazine and article on pp. 82-88.

Excerpts from Golf Digest; magazine; Feb. 2005; Article entitled: "The Hot List", cover page from magazine and article on pp. 119-130. (Part 1).

Excerpts from Golf Digest; magazine; Feb. 2005; Article entitled: "The Hot List", article on pp. 131-143. (Part 2).

Excerpts from Golf Digest; magazine; Feb. 2006; Article entitled: "The Hot List", cover page from magazine and article on pp. 122-132. (Part 1).

Excerpts from Golf Digest; magazine; Feb. 2006; Article entitled: "The Hot List", article on pp. 133-143. (Part 2).

Excerpts from Golf Digest; magazine; Feb. 2007; Article entitled: "The Hot List", cover page from magazine and article on pp. 130-151.

Excerpts from Golf Digest; magazine; Feb. 2008; Article entitled: "The Hot List", cover page from magazine and article on pp. 114-139.

Excerpts from Golf Digest; magazine; Feb. 2009; Article entitled: "The Hot List", cover page from magazine and article on pp. 101-127.

International Searching Authority (USPTO), International Search Report and Written Opinion for International Application No. PCT/US2009/049418, mailed Aug. 26, 2009, 10 pages.

Declaration, Year: 2012.

"Cleveland HiBore Driver Review," http://thesandtrip.com , 7 pages, May 19, 2006.

"Invalidity Search Report for Japanese Registered Patent No. 4128970," 4pg. (Nov. 29, 2013.).

* cited by examiner

AERODYNAMIC GOLF CLUB HEAD

CROSS-REFERENCE TO RELATED APPLICATIONS

This application is a continuation of U.S. nonprovisional application Ser. No. 17/485,977, filed on Sep. 27, 2021, which is a continuation of U.S. nonprovisional application Ser. No. 16/707,774, filed on Dec. 9, 2019, now U.S. Pat. No. 11,130,026, which is a continuation of U.S. nonprovisional application Ser. No. 16/105,001, filed on Aug. 20, 2018, now U.S. Pat. No. 10,500,451, which is a continuation of U.S. nonprovisional application Ser. No. 15/603,605, filed on May 24, 2017, now U.S. patent Ser. No. 10/052,531, which is a continuation of U.S. nonprovisional application Ser. No. 15/012,880, filed on Feb. 2, 2016, now U.S. Pat. No. 9,682,294, which is a continuation of U.S. nonprovisional application Ser. No. 14/260,328, filed on Apr. 24, 2014, now U.S. Pat. No. 9,278,266, which is a continuation of U.S. nonprovisional application Ser. No. 14/069,503, now U.S. Pat. No. 8,734,269, filed on Nov. 1, 2013, which is a continuation of U.S. nonprovisional application Ser. No. 13/969,670, now U.S. Pat. No. 8,602,909, filed on Aug. 19, 2013, which is a continuation of U.S. nonprovisional application Ser. No. 13/670,703, now U.S. Pat. No. 8,550,936, filed on Nov. 7, 2012, which is a continuation of U.S. nonprovisional application Ser. No. 13/304,863, now abandoned, filed on Nov. 28, 2011, which is a continuation of U.S. nonprovisional application Ser. No. 12/367,839, now U.S. Pat. No. 8,083,609, filed on Feb. 9, 2009, which claims the benefit of U.S. provisional patent application Ser. No. 61/080,892, filed on Jul. 15, 2008, and U.S. provisional patent application Ser. No. 61/101,919, filed on Oct. 1, 2008, all of which are incorporated by reference as if completely written herein.

STATEMENT REGARDING FEDERALLY SPONSORED RESEARCH OR DEVELOPMENT

This invention was not made as part of a federally sponsored research or development project.

TECHNICAL FIELD

The present invention relates to sports equipment; particularly, to a high volume aerodynamic golf club head.

BACKGROUND OF THE INVENTION

Modern high volume golf club heads, namely drivers, are being designed with little, if any, attention paid to the aerodynamics of the golf club head. This stems in large part from the fact that in the past the aerodynamics of golf club heads were studied and it was found that the aerodynamics of the club head had only minimal impact on the performance of the golf club.

The drivers of today have club head volumes that are often double the volume of the most advanced club heads from just a decade ago. In fact, virtually all modern drivers have club head volumes of at least 400 cc, with a majority having volumes right at the present USGA mandated limit of 460 cc. Still, golf club designers pay little attention to the aerodynamics of these large golf clubs; often instead focusing solely on increasing the club head's resistance to twisting during off-center shots.

The modern race to design golf club heads that greatly resist twisting, meaning that the club heads have large moments of inertia, has led to club heads having very long front-to-back dimensions. The front-to-back dimension of a golf club head, often annotated the FB dimension, is measured from the leading edge of the club face to the furthest back portion of the club head. Currently, in addition to the USGA limit on the club head volume, the USGA limits the front-to-back dimension (FB) to 5 inches and the moment of inertia about a vertical axis passing through the club head's center of gravity (CG), referred to as MOIy, to 5900 g*cm$^2$. One of skill in the art will know the meaning of "center of gravity," referred to herein as CG, from an entry level course on mechanics. With respect to wood-type golf clubs, which are generally hollow and/or having non-uniform density, the CG is often thought of as the intersection of all the balance points of the club head. In other words, if you balance the head on the face and then on the sole, the intersection of the two imaginary lines passing straight through the balance points would define the point referred to as the CG.

Until just recently the majority of drivers had what is commonly referred to as a "traditional shape" and a 460 cc club head volume. These large volume traditional shape drivers had front-to-back dimensions (FB) of approximately 4.0 inches to 4.3 inches, generally achieving an MOIy in the range of 4000-4600 g*cm$^2$. As golf club designers strove to increase MOIy as much as possible, the FB dimension of drivers started entering the range of 4.3 inches to 5.0 inches. The graph of FIG. 1 shows the FB dimension and MOIy of 83 different club head designs and nicely illustrates that high MOIy values come with large FB dimensions.

While increasing the FB dimension to achieve higher MOIy values is logical, significant adverse effects have been observed in these large FB dimension clubs. One significant adverse effect is a dramatic reduction in club head speed, which appears to have gone unnoticed by many in the industry. The graph of FIG. 2 illustrates player test data with drivers having an FB dimension greater than 3.6 inches. The graph illustrates considerably lower club head speeds for large FB dimension drivers when compared to the club head speeds of drivers having FB dimensions less than 4.4 inches. In fact, a club head speed of 104.6 mph was achieved when swinging a driver having a FB dimension of less than 3.8 inches, while the swing speed dropped over 3% to 101.5 mph when swinging a driver with a FB dimension of slightly less than 4.8 inches.

This significant decrease in club head speed is the result of the increase in aerodynamic drag forces associated with large FB dimension golf club heads. Data obtained during extensive wind tunnel testing shows a strong correlation between club head FB dimension and the aerodynamic drag measured at several critical orientations. First, orientation one is identified in FIG. 11 with a flow arrow labeled as "Air Flow—90°" and is referred to in the graphs of the figures as "lie 90 degree orientation." This orientation can be thought of as the club head resting on the ground plane (GP) with the shaft axis (SA) at the club head's design lie angle, as seen in FIG. 8. Then a 100 mph wind is directed parallel to the ground plane (GP) directly at the club face (200), as illustrated by the flow arrow labeled "Air Flow—90°" in FIG. 11.

Secondly, orientation two is identified in FIG. 11 with a flow arrow labeled as "Air Flow—60°" and is referred to in the graphs of the figures as "lie 60 degree orientation." This orientation can be thought of as the club head resting on the ground plane (GP) with the shaft axis (SA) at the club head's design lie angle, as seen in FIG. 8. Then a 100 mph wind is wind is oriented thirty degrees from a vertical plane normal to the face (200) with the wind originating from the heel (116) side of the club head, as illustrated by the flow arrow labeled "Air Flow—60°" in FIG. 11.

Thirdly, orientation three is identified in FIG. 12 with a flow arrow labeled as "Air Flow—Vert.—0°" and is referred to in the graphs of the figures as "vertical 0 degree orientation." This orientation can be thought of as the club head being oriented upside down with the shaft axis (SA) vertical while being exposed to a horizontal 100 mph wind directed at the heel (116), as illustrated by the flow arrow labeled "Air Flow—Vert.—0°" in FIG. 12. Thus, the air flow is parallel to the vertical plane created by the shaft axis (SA) seen in FIG. 11, blowing from the heel (116) to the toe (118) but with the club head oriented as seen in FIG. 12.

Now referring back to orientation one, namely the orientation identified in FIG. 11 with a flow arrow labeled as "Air Flow—90°." Normalized aerodynamic drag data has been gathered for six different club heads and is illustrated in the graph of FIG. 5. At this point it is important to understand that all of the aerodynamic drag forces mentioned herein, unless otherwise stated, are aerodynamic drag forces normalized to a 120 mph airstream velocity. Thus, the illustrated aerodynamic drag force values are the actual measured drag force at the indicated airstream velocity multiplied by the square of the reference velocity, which is 120 mph, then divided by the square of the actual airstream velocity. Therefore, the normalized aerodynamic drag force plotted in FIG. 5 is the actual measured drag force when subjected to a 100 mph wind at the specified orientation, multiplied by the square of the 120 mph reference velocity, and then divided by the square of the 100 mph actual airstream velocity.

Still referencing FIG. 5, the normalized aerodynamic drag force increases non-linearly from a low of 1.2 lbf with a short 3.8 inch FB dimension club head to a high of 2.65 lbf for a club head having a FB dimension of almost 4.8 inches. The increase in normalized aerodynamic drag force is in excess of 120% as the FB dimension increases slightly less than one inch, contributing to the significant decrease in club head speed previously discussed.

The results are much the same in orientation two, namely the orientation identified in FIG. 11 with a flow arrow labeled as "Air Flow—60°." Again, normalized aerodynamic drag data has been gathered for six different club heads and is illustrated in the graph of FIG. 4. The normalized aerodynamic drag force increases non-linearly from a low of approximately 1.1 lbf with a short 3.8 inch FB dimension club head to a high of approximately 1.9 lbf for a club head having a FB dimension of almost 4.8 inches. The increase in normalized aerodynamic drag force is almost 73% as the FB dimension increases slightly less than one inch, also contributing to the significant decrease in club head speed previously discussed.

Again, the results are much the same in orientation three, namely the orientation identified in FIG. 12 with a flow arrow labeled as "Air Flow—Vert.—0°." Again, normalized aerodynamic drag data has been gathered for several different club heads and is illustrated in the graph of FIG. 3. The normalized aerodynamic drag force increases non-linearly from a low of approximately 1.15 lbf with a short 3.8 inch FB dimension club head to a high of approximately 2.05 lbf for a club head having a FB dimension of almost 4.8 inches. The increase in normalized aerodynamic drag force is in excess of 78% as the FB dimension increases slightly less than one inch, also contributing to the significant decrease in club head speed previously discussed.

Further, the graph of FIG. 6 correlates the player test club head speed data of FIG. 2 with the maximum normalized aerodynamic drag force for each club head from FIG. 3, 4, or 5. Thus, FIG. 6 shows that the club head speed drops from 104.6 mph, when the maximum normalized aerodynamic drag force is only 1.2 lbf, down to 101.5 mph, when the maximum normalized aerodynamic drag force is 2.65 lbf.

The drop in club head speed just described has a significant impact on the speed at which the golf ball leaves the club face after impact and thus the distance that the golf ball travels. In fact, for a club head speed of approximately 100 mph, each 1 mph reduction in club head speed results in approximately a 1% loss in distance. The present golf club head has identified these relationships, the reason for the drop in club head speed associated with long FB dimension clubs, and several ways to reduce the aerodynamic drag force of golf club heads.

SUMMARY OF THE INVENTION

The claimed aerodynamic golf club head has recognized that the poor aerodynamic performance of large FB dimension drivers is not due solely to the large FB dimension; rather, in an effort to create large FB dimension drivers with a high MOIy value and low center of gravity (CG) dimension, golf club designers have generally created clubs that have very poor aerodynamic shaping. Several problems are the significantly flat surfaces on the body, the lack of proper shaping to account for airflow reattachment in the crown area trailing the face, and the lack of proper trailing edge design. In addition, current large FB dimension driver designs have ignored, or even tried to maximize in some cases, the frontal cross sectional area of the golf club head which increases the aerodynamic drag force.

The present aerodynamic golf club head solves these issues and results in a high volume aerodynamic golf club head having a relatively large FB dimension with beneficial moment of inertia values, while also obtaining superior aerodynamic properties unseen by other large volume, large FB dimension, high MOI golf club heads. The golf club head obtains superior aerodynamic performance through the use of unique club head shapes defined by numerous variables including, but not limited to, a crown apex located an apex height above a ground plane, and three distinct radii that improve the aerodynamic performance.

The club head has a crown section having a portion between the crown apex and a front of the club head with an apex-to-front radius of curvature that is less than 3 inches. Likewise, a portion of the crown section between the crown apex and a back of the club head has an apex-to-rear radius of curvature that is less than 3.75 inches. Lastly, a portion of the crown section has a heel-to-toe radius of curvature at the crown apex in a direction parallel to a vertical plane created by a shaft axis that is less than 4 inches. Such small radii of curvature herein have traditionally been avoided in the design of high volume golf club heads, especially in the design of high volume golf club heads having FB dimensions of 4.4 inches and greater. However, these tight radii produce a bulbous crown section that facilitates airflow reattachment as close to a club head face as possible, thereby resulting in reduced aerodynamic drag forces and producing higher club head speeds.

BRIEF DESCRIPTION OF THE DRAWINGS

Without limiting the scope of the present aerodynamic golf club head as claimed below and referring now to the drawings and figures:

Figure 1:
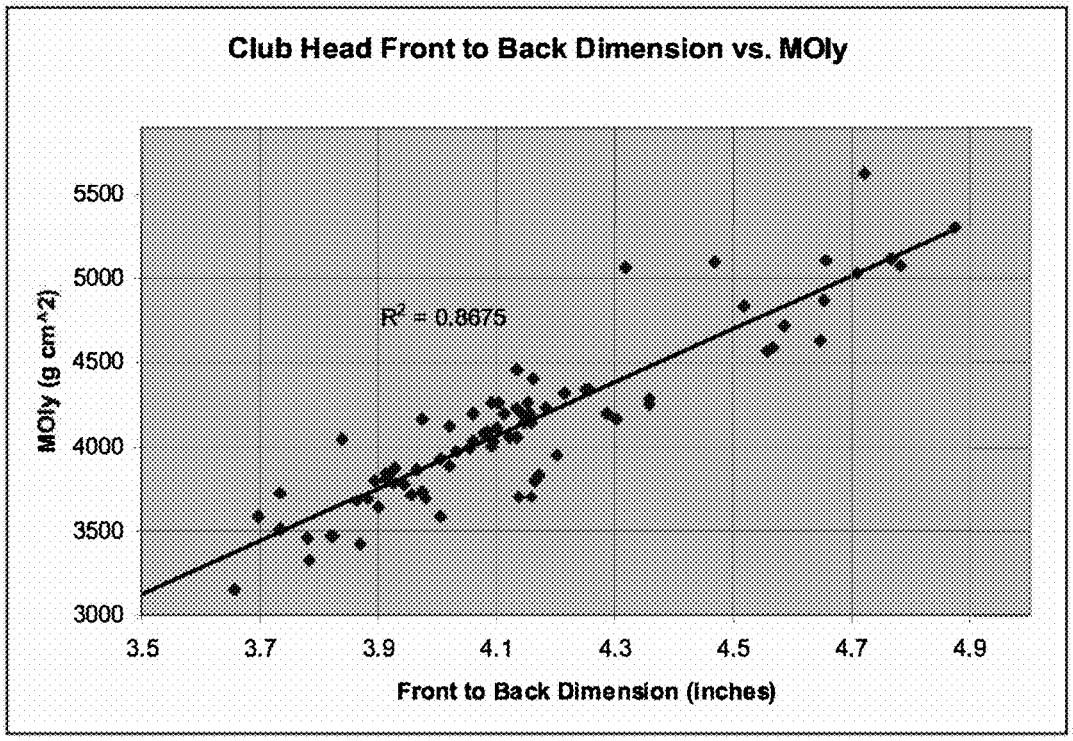
FIG. 1 shows a graph of FB dimensions versus MOIy.
Figure 2:
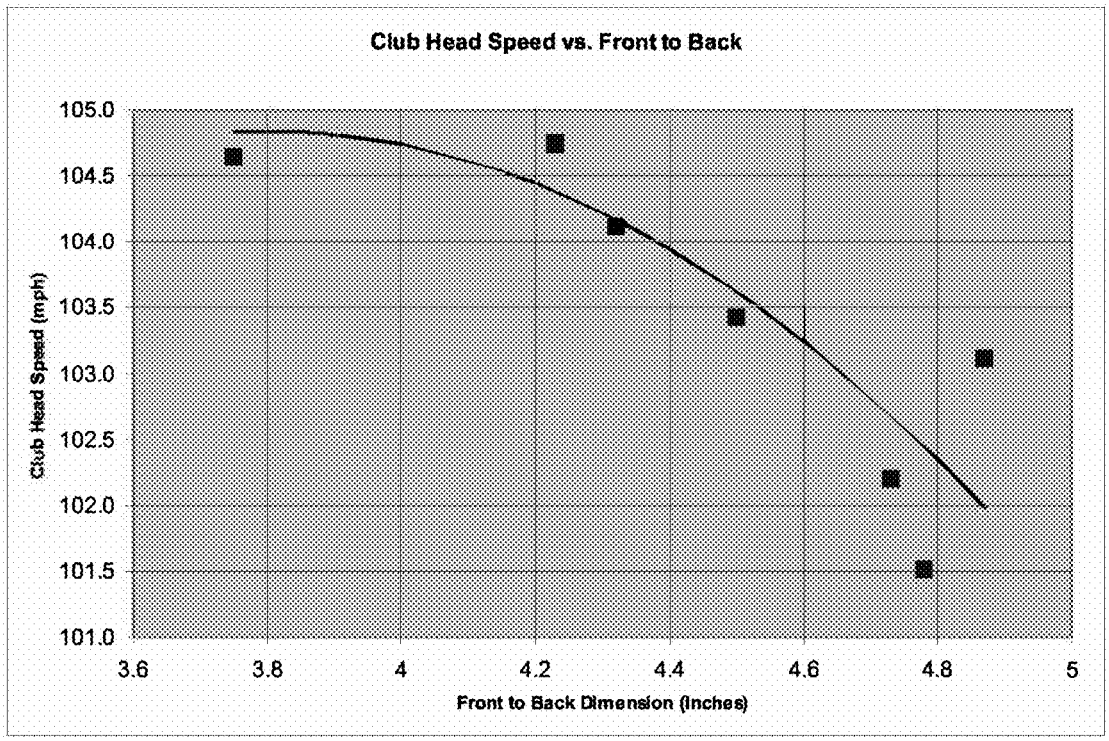
FIG. 2 shows a graph of FB dimensions versus club head speed.
Figure 3:
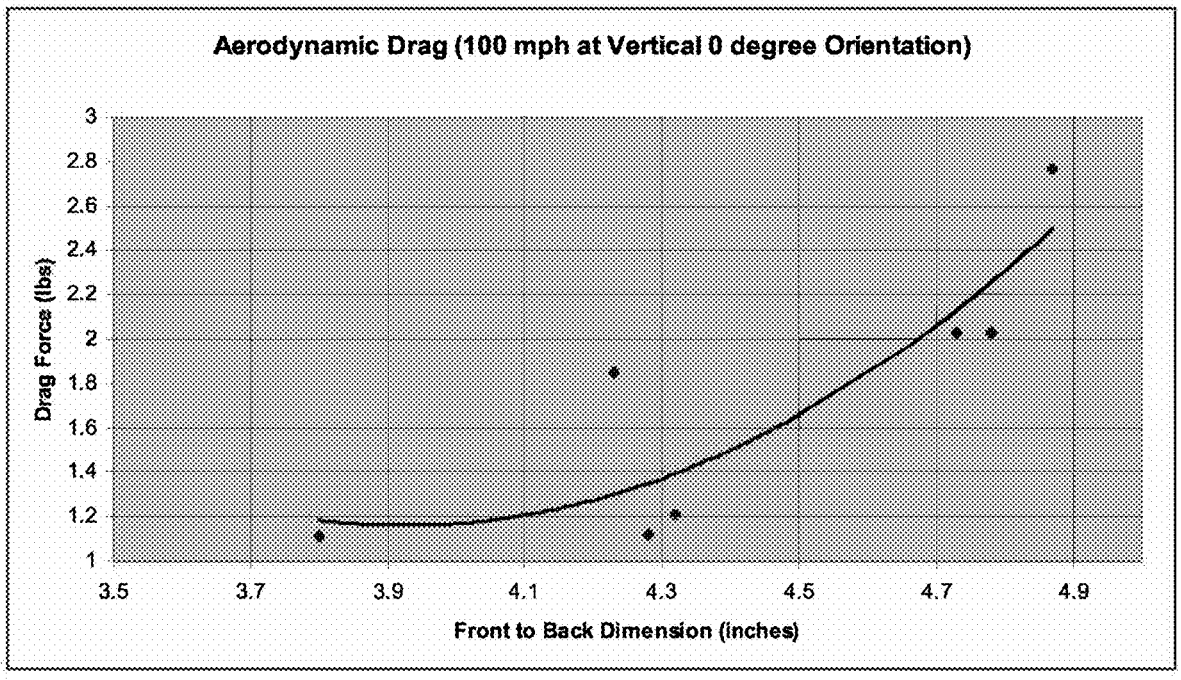
FIG. 3 shows a graph of FB dimensions versus club head normalized aerodynamic drag force.
Figure 4:
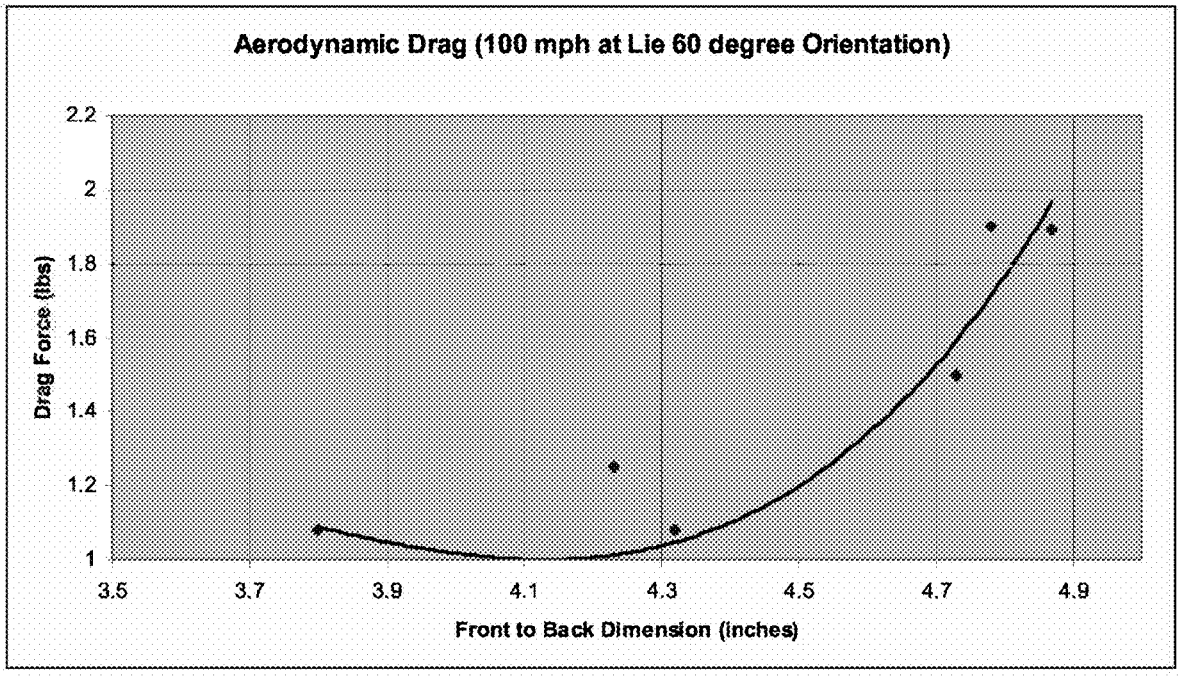
FIG. 4 shows a graph of FB dimensions versus club head normalized aerodynamic drag force.
Figure 5:
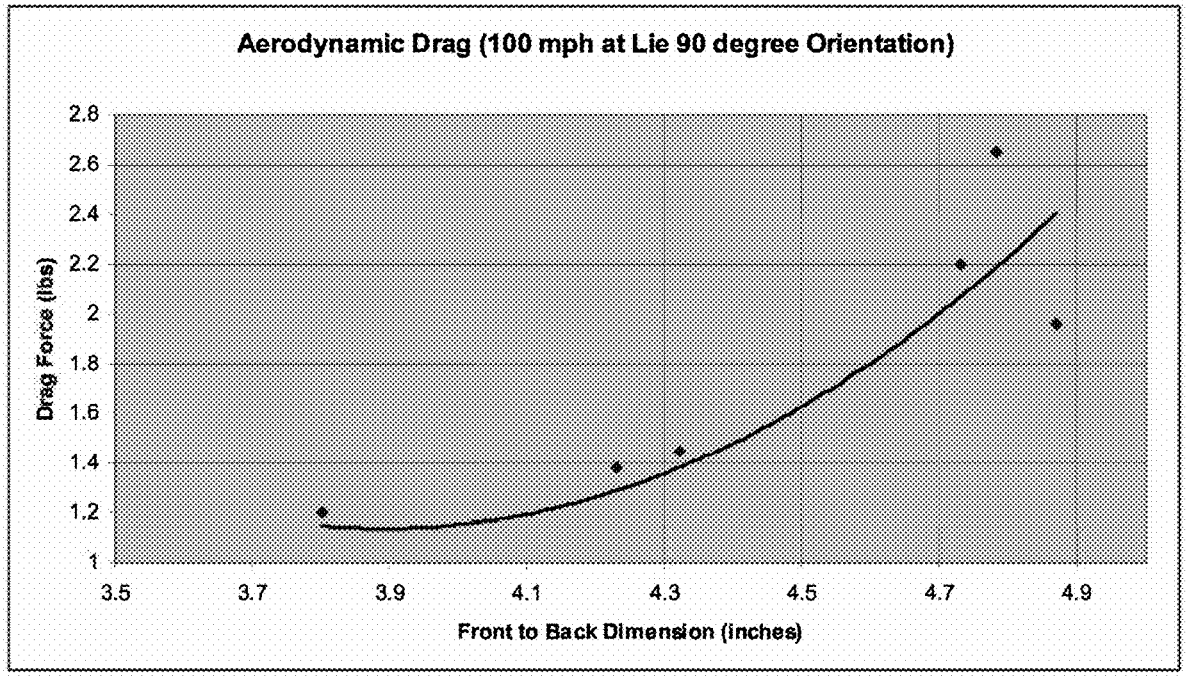
FIG. 5 shows a graph of FB dimensions versus club head normalized aerodynamic drag force.
Figure 6:
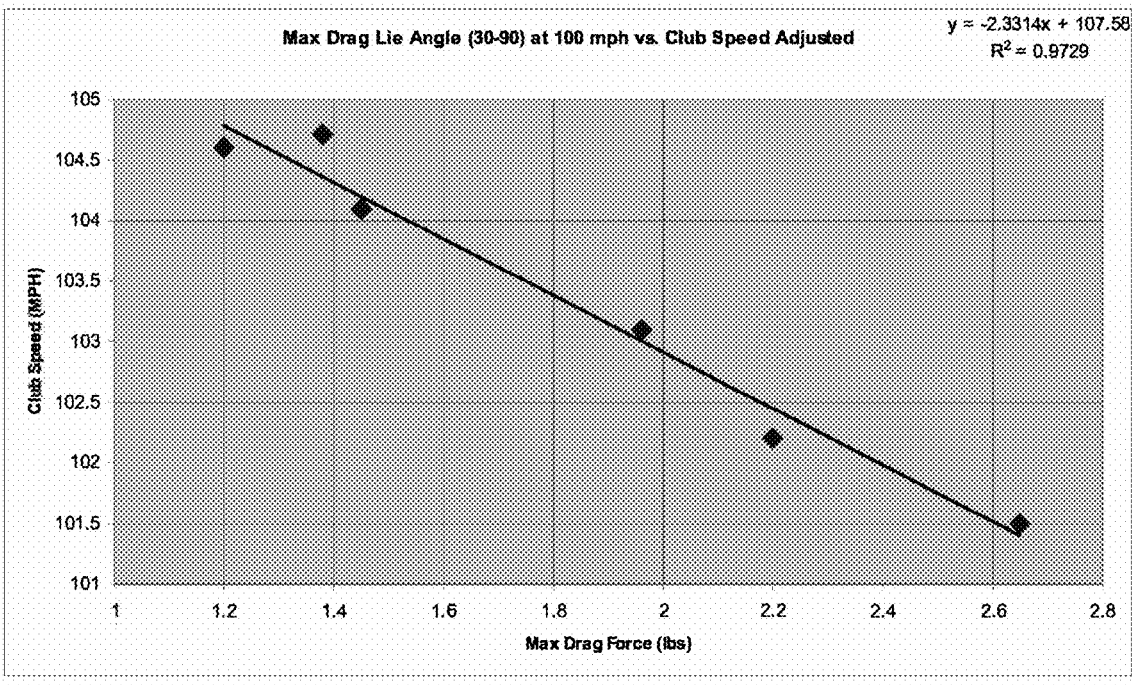
FIG. 6 shows a graph of club head normalized aerodynamic drag force versus club head speed.

These drawings are provided to assist in the understanding of the exemplary embodiments of the high volume aerodynamic golf club head as described in more detail below and should not be construed as unduly limiting the present golf club head. In particular, the relative spacing, positioning, sizing and dimensions of the various elements illustrated in the drawings are not drawn to scale and may have been exaggerated, reduced or otherwise modified for the purpose of improved clarity. Those of ordinary skill in the art will also appreciate that a range of alternative configurations have been omitted simply to improve the clarity and reduce the number of drawings.

DETAILED DESCRIPTION OF THE INVENTION

The claimed high volume aerodynamic golf club head (100) enables a significant advance in the state of the art. The preferred embodiments of the club head (100) accomplish this by new and novel arrangements of elements and methods that are configured in unique and novel ways and which demonstrate previously unavailable but preferred and desirable capabilities. The description set forth below in connection with the drawings is intended merely as a description of the presently preferred embodiments of the club head (100), and is not intended to represent the only form in which the club head (100) may be constructed or utilized. The description sets forth the designs, functions, means, and methods of implementing the club head (100) in connection with the illustrated embodiments. It is to be understood, however, that the same or equivalent functions and features may be accomplished by different embodiments that are also intended to be encompassed within the spirit and scope of the club head (100).

The present high volume aerodynamic golf club head (100) has recognized that the poor aerodynamic performance of large FB dimension drivers is not due solely to the large FB dimension; rather, in an effort to create large FB dimension drivers with a high MOIy value and low center of gravity (CG) dimension, golf club designers have generally created clubs that have very poor aerodynamic shaping. The main problems are the significantly flat surfaces on the body, the lack of proper shaping to account for airflow reattachment in the crown area trailing the face, and the lack of proper trailing edge design. In addition, current large FB dimension driver designs have ignored, or even tried to maximize in some cases, the frontal cross sectional area of the golf club head which increases the aerodynamic drag force. The present aerodynamic golf club head (100) solves these issues and results in a high volume aerodynamic golf club head (100) having a large FB dimension and a high MOIy.

The present high volume aerodynamic golf club head (100) has a volume of at least 400 cc. It is characterized by a face-on normalized aerodynamic drag force of less than 1.5 lbf when exposed to a 100 mph wind parallel to the ground plane (GP) when the high volume aerodynamic golf club head (100) is positioned in a design orientation and the wind is oriented at the front (112) of the high volume aerodynamic golf club head (100), as previously described with respect to FIG. 11 and the flow arrow labeled "air flow—90°." As explained in the "Background" section, but worthy of repeating in this section, all of the aerodynamic drag forces mentioned herein, unless otherwise stated, are aerodynamic drag forces normalized to a 120 mph airstream velocity. Thus, the above mentioned normalized aerodynamic drag force of less than 1.5 lbf when exposed to a 100 mph wind is the actual measured drag force at the indicated 100 mph airstream velocity multiplied by the square of the reference velocity, which is 120 mph, then divided by the square of the actual airstream velocity, which is 100 mph.

Figure 7:
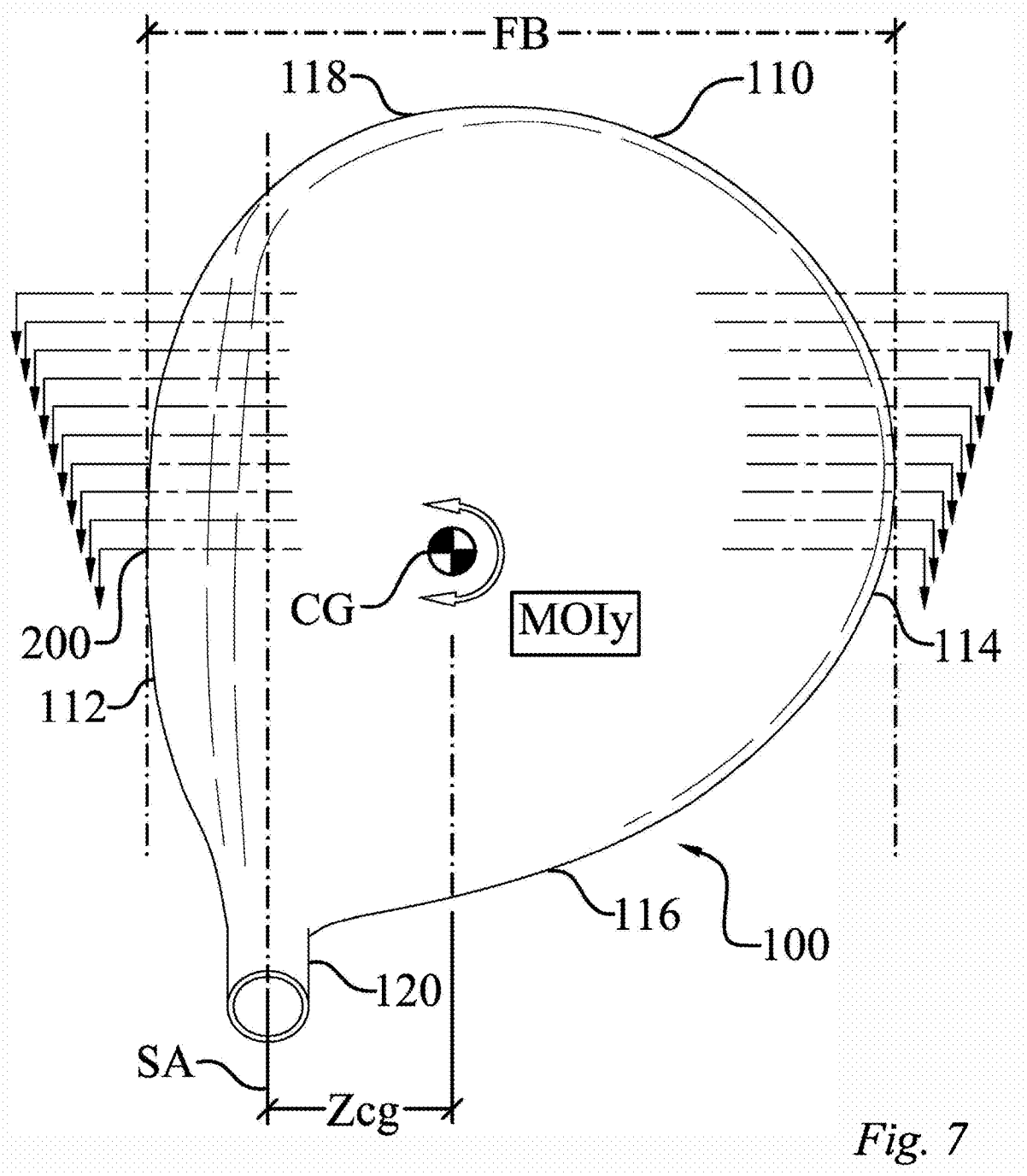
FIG. 7 shows a top plan view of a high volume aerodynamic golf club head, not to scale.
Figure 8:
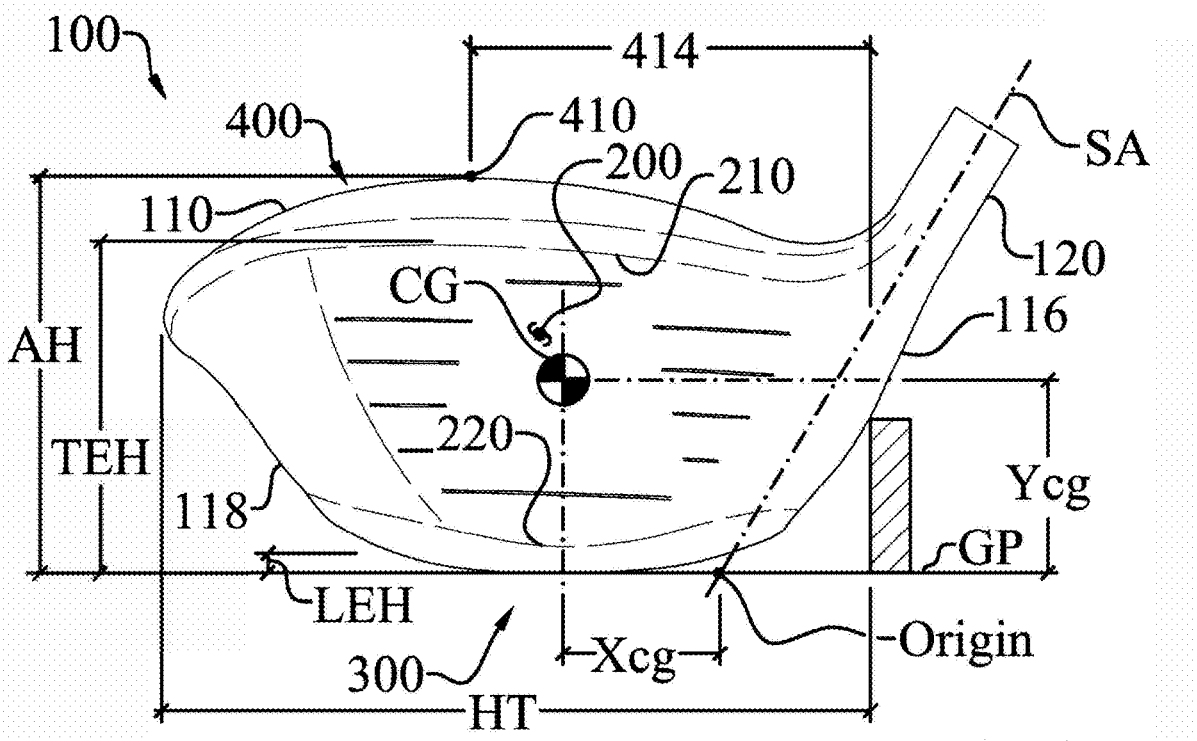
FIG. 8 shows a front elevation view of a high volume aerodynamic golf club head, not to scale.
Figure 9:
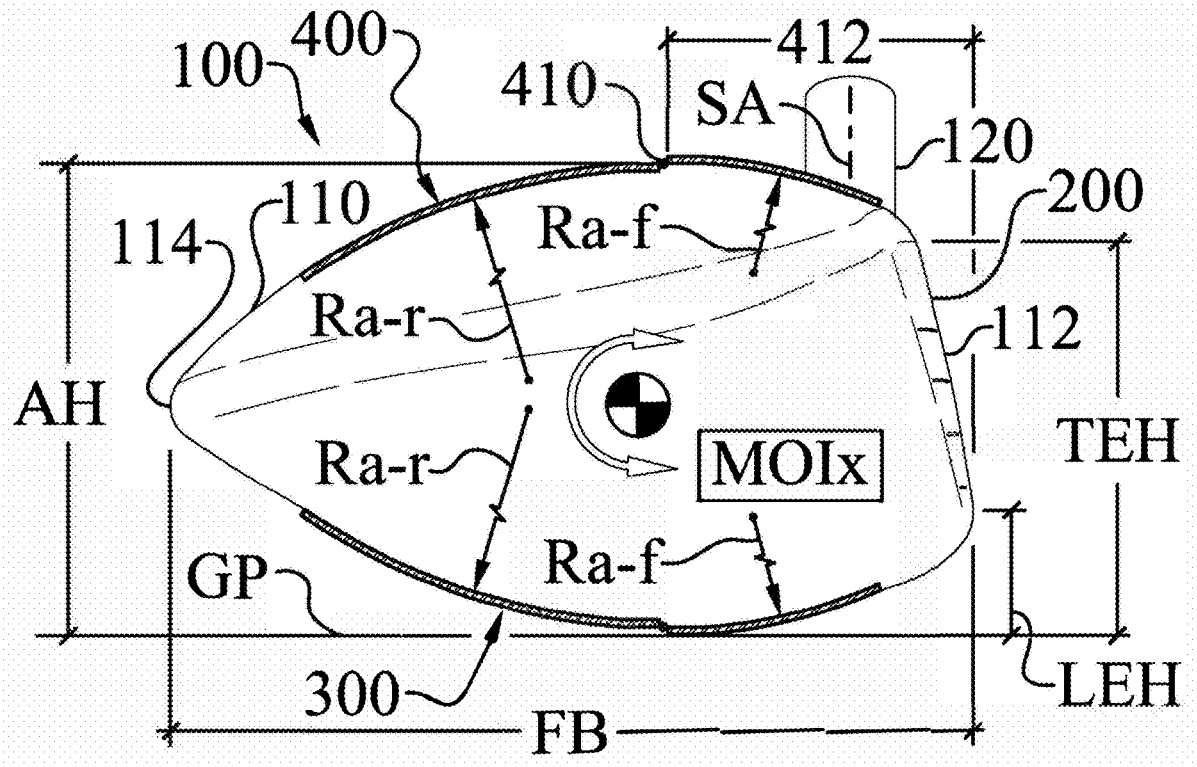
FIG. 9 shows a toe side elevation view of a high volume aerodynamic golf club head, not to scale.

With general reference to FIGS. 7-9, the high volume aerodynamic golf club head (100) includes a hollow body (110) having a face (200), a sole section (300), and a crown section (400). The hollow body (110) may be further defined as having a front (112), a back (114), a heel (116), and a toe (118). Further, the hollow body (110) has a front-to-back dimension (FB) of at least 4.4 inches, as previously defined and illustrated in FIG. 7.

The relatively large FB dimension of the present high volume aerodynamic golf club head (100) aids in obtaining beneficial moment of inertia values while also obtaining superior aerodynamic properties unseen by other large volume, large FB dimension, high MOI golf club heads. Specifically, an embodiment of the high volume aerodynamic golf club head (100) obtains a first moment of inertia (MOIy) about a vertical axis through a center of gravity (CG) of the golf club head (100), illustrated in FIG. 7, that is at least 4000 g*cm$^2$. MOIy is the moment of inertia of the golf club head (100) that resists opening and closing moments induced by ball strikes towards the toe side or heel side of the face. Further, this embodiment obtains a second moment of inertia (MOIx) about a horizontal axis through the center of gravity (CG), as seen in FIG. 9, that is at least 2000 g*cm$^2$. MOIx is the moment of inertia of the golf club head (100) that resists lofting and delofting moments induced by ball strikes high or low on the face (200).

Figure 10:
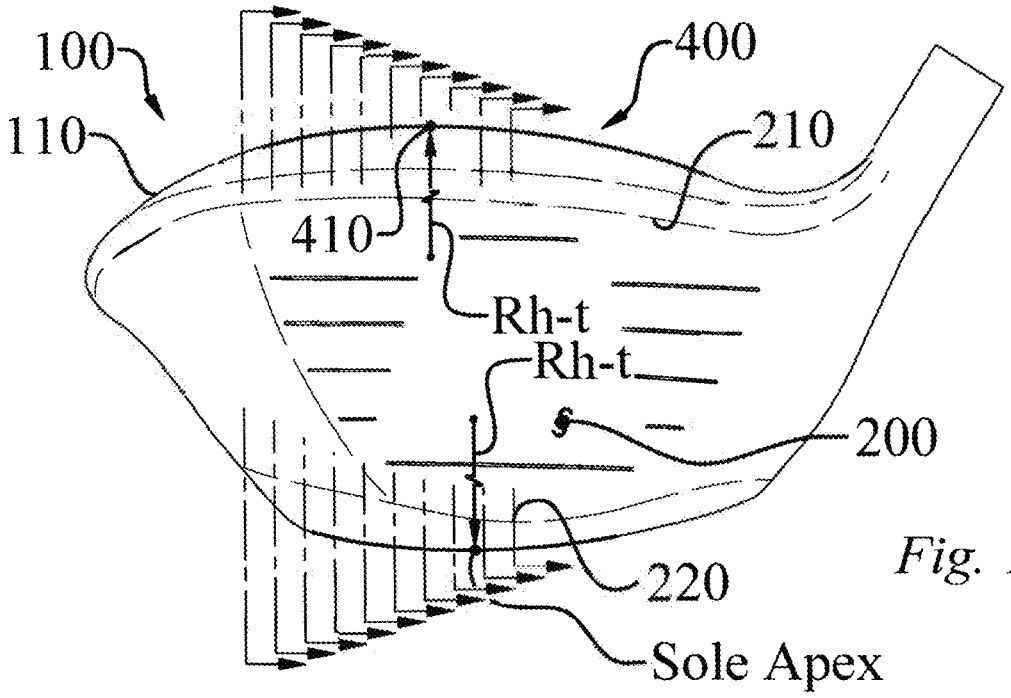
FIG. 10 shows a front elevation view of a high volume aerodynamic golf club head, not to scale.

The golf club head (100) obtains superior aerodynamic performance through the use of unique club head shapes. Referring now to FIG. 8, the crown section (400) has a crown apex (410) located an apex height (AH) above a ground plane (GP). The apex height (AH), as well as the location of the crown apex (410), play important roles in obtaining desirable airflow reattachment as close to the face (200) as possible, as well as improving the airflow attachment to the crown section (400). With reference now to FIGS. 9 and 10, the crown section (400) has three distinct radii that improve the aerodynamic performance of the present club head (100). First, as seen in FIG. 9, a portion of the crown section (400) between the crown apex (410) and the front (112) has an apex-to-front radius of curvature (Ra-f) that is less than 3 inches. The apex-to-front radius of curvature (Ra-f) is measured in a vertical plane that is perpendicular to a vertical plane passing through the shaft axis (SA), and the apex-to-front radius of curvature (Ra-f) is further measured at the point on the crown section (400) between the crown apex (410) and the front (112) that has the smallest the radius of curvature. In one particular embodiment, at least fifty percent of the vertical plane cross sections taken perpendicular to a vertical plane passing through the shaft axis (SA), which intersect a portion of a face top edge (210), are characterized by an apex-to-front radius of curvature (Ra-f) of less than 3 inches. In still a further embodiment, at least ninety percent of the vertical plane cross sections taken perpendicular to a vertical plane passing through the shaft axis (SA), which intersect a portion of the face top edge (210), are characterized by an apex-to-front radius of curvature (Ra-f) of less than 3 inches. In yet another embodiment, at least fifty percent of the vertical plane cross sections taken perpendicular to a vertical plane passing through the shaft axis (SA), which intersect a portion of the face top edge (210) between the center of the face (200) and the toeward most point on the face (200), are characterized by an apex-to-front radius of curvature (Ra-f) of less than 3 inches. Still further, another embodiment has at least fifty percent of the vertical plane cross sections taken perpendicular to a vertical plane passing through the shaft axis (SA), which intersect a portion of the face top edge (210) between the center of the face (200) and the toeward most point on the face (200), are characterized by an apex-to-front radius of curvature (Ra-f) of less than 3 inches.

The center of the face (200) shall be determined in accordance with the USGA "Procedure for Measuring the Flexibility of a Golf Clubhead," Revision 2.0, Mar. 25, 2005, which is incorporated herein by reference. This USGA procedure identifies a process for determining the impact location on the face of a golf club that is to be tested, also referred therein as the face center. The USGA procedure utilizes a template that is placed on the face of the golf club to determine the face center.

Secondly, a portion of the crown section (400) between the crown apex (410) and the back (114) of the hollow body (110) has an apex-to-rear radius of curvature (Ra-r) that is less than 3.75 inches. The apex-to-rear radius of curvature (Ra-r) is also measured in a vertical plane that is perpendicular to a vertical plane passing through the shaft axis (SA), and the apex-to-rear radius of curvature (Ra-r) is further measured at the point on the crown section (400) between the crown apex (410) and the back (114) that has the smallest the radius of curvature. In one particular embodiment, at least fifty percent of the vertical plane cross sections taken perpendicular to a vertical plane passing through the shaft axis (SA), which intersect a portion of the face top edge (210), are characterized by an apex-to-rear radius of curvature (Ra-r) of less than 3.75 inches. In still a further embodiment, at least ninety percent of the vertical plane cross sections taken perpendicular to a vertical plane passing through the shaft axis (SA), which intersect a portion of the face top edge (210), are characterized by an apex-to-rear radius of curvature (Ra-r) of less than 3.75 inches. In yet another embodiment, one hundred percent of the vertical plane cross sections taken perpendicular to a vertical plane passing through the shaft axis (SA), which intersect a portion of the face top edge (210) between the center of the face (200) and the toeward most point on the face (200), are characterized by an apex-to-rear radius of curvature (Ra-r) of less than 3.75 inches.

Lastly, as seen in FIG. 10, a portion of the crown section (400) has a heel-to-toe radius of curvature (Rh-t) at the crown apex (410) in a direction parallel to the vertical plane created by the shaft axis (SA) that is less than 4 inches. In a further embodiment, at least ninety percent of the crown section (400) located between the most heelward point on the face (200) and the most toeward point on the face (200) has a heel-to-toe radius of curvature (Rh-t) at the crown apex (410) in a direction parallel to the vertical plane created by the shaft axis (SA) that is less than 4 inches. A further embodiment has one hundred percent of the crown section (400) located between the most heelward point on the face (200) and the most toeward point on the face (200) exhibiting a heel-to-toe radius of curvature (Rh-t), at the crown apex (410) in a direction parallel to the vertical plane created by the shaft axis (SA), that is less than 4 inches.

Such small radii of curvature exhibited in the embodiments described herein have traditionally been avoided in the design of high volume golf club heads, especially in the design of high volume golf club heads having FB dimensions of 4.4 inches and greater. However, it is these tight radii produce a bulbous crown section (400) that facilitates airflow reattachment as close to the face (200) as possible, thereby resulting in reduced aerodynamic drag forces and facilitating higher club head speeds.

Conventional high volume large MOIy golf club heads having large FB dimensions, such as those seen in USPN D544939 and USPN D543600, have relatively flat crown sections that often never extend above the face. While these designs appear as though they should cut through the air, the opposite is often true with such shapes achieving poor airflow reattachment characteristics and increased aerodynamic drag forces. The present club head (100) has recognized the significance of proper club head shaping to account for rapid airflow reattachment in the crown section (400) trailing the face (200), which is quite the opposite of the flat steeply sloped crown sections of many prior art large FB dimension club heads.

With reference now to FIG. 10, the face (200) has a top edge (210) and a lower edge (220). Further, as seen in FIGS. 8 and 9, the top edge (210) has a top edge height (TEH) that is the elevation of the top edge (210) above the ground plane (GP). Similarly, the lower edge (220) has a lower edge height (LEH) that is the elevation of the lower edge (220) above the ground plane (GP). The highest point along the top edge (210) produces a maximum top edge height (TEH) that is at least 2 inches. Similarly, the lowest point along the lower edge (220) is a minimum lower edge height (LEH).

One of many significant advances of this embodiment of the present club head (100) is the design of an apex ratio that encourages airflow reattachment on the crown section (400) of the golf club head (100) as close to the face (200) as possible. In other words, the sooner that airflow reattachment is achieved, the better the aerodynamic performance and the smaller the aerodynamic drag force. The apex ratio is the ratio of apex height (AH) to the maximum top edge height (TEH). As previously explained, in many large FB dimension golf club heads the apex height (AH) is no more than the top edge height (TEH). In this embodiment, the apex ratio is at least 1.13, thereby encouraging airflow reattachment as soon as possible.

Figure 13:
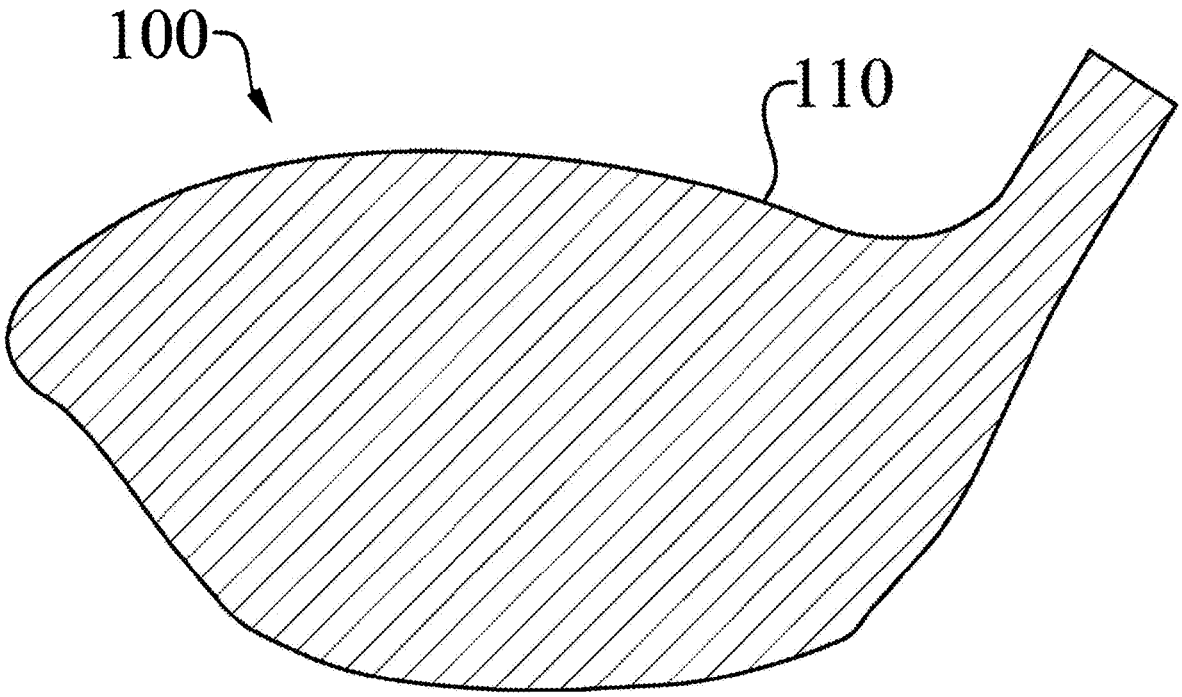
FIG. 13 shows a front elevation view of a high volume aerodynamic golf club head, not to scale.

Still further, this embodiment of the club head (100) has a frontal cross sectional area that is less than 11 square inches. The frontal cross sectional area is the single plane area measured in a vertical plane bounded by the outline of the golf club head (100) when it is resting on the ground plane (GP) at the design lie angle and viewed from directly in front of the face (200). The frontal cross sectional area is illustrated by the cross-hatched area of FIG. 13.

Figure 11:
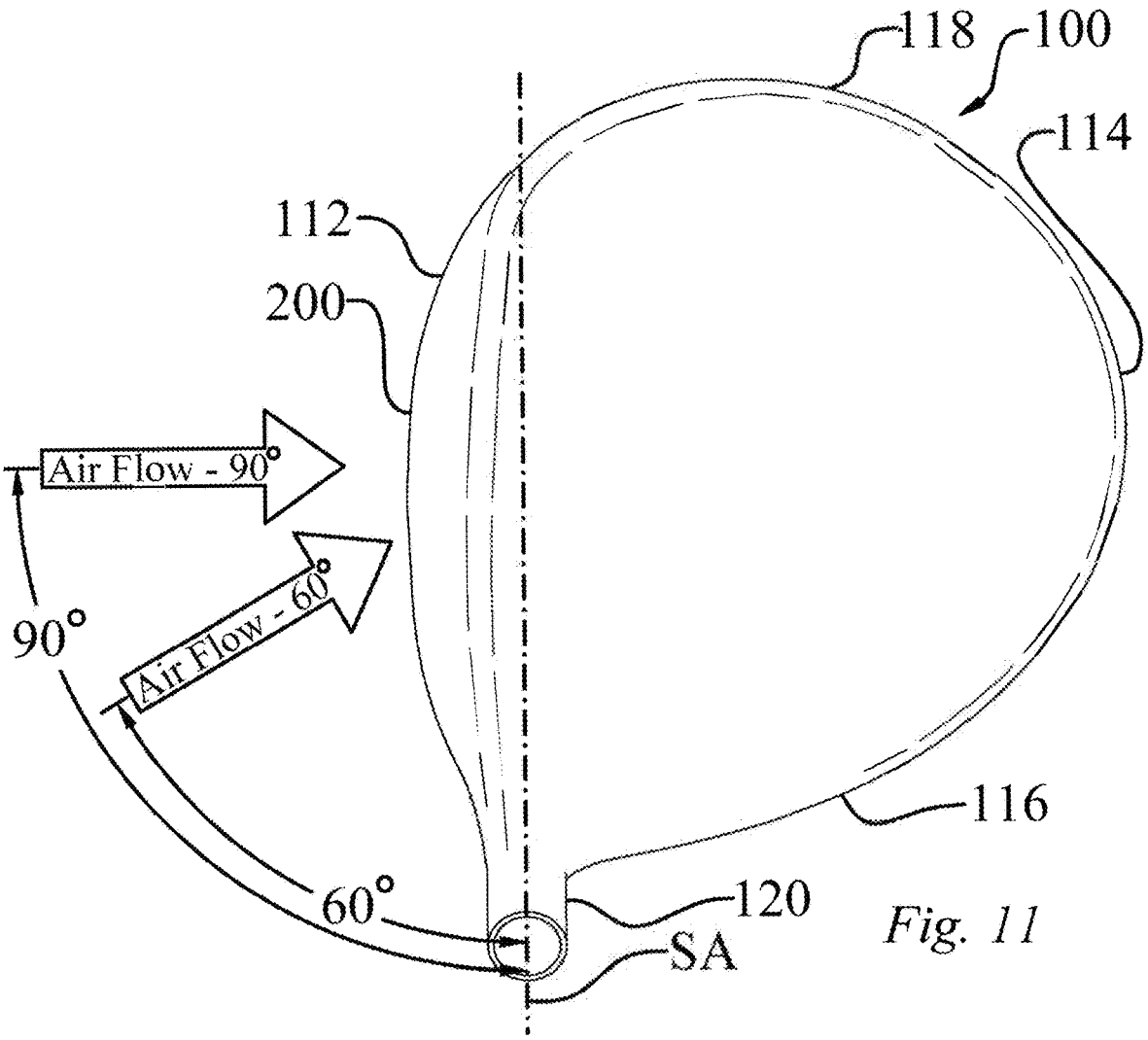
FIG. 11 shows a top plan view of a high volume aerodynamic golf club head, not to scale.

In a further embodiment, a second aerodynamic drag force is introduced, namely the 30 degree offset aerodynamic drag force, as previously explained with reference to FIG. 11. In this embodiment the 30 degree offset normalized aerodynamic drag force is less than 1.3 lbf when exposed to a 100 mph wind parallel to the ground plane (GP) when the high volume aerodynamic golf club head (100) is positioned in a design orientation and the wind is oriented thirty degrees from a vertical plane normal to the face (200) with the wind originating from the heel (116) side of the high volume aerodynamic golf club head (100). In addition to having the face-on normalized aerodynamic drag force less than 1.5 lbf, introducing a 30 degree offset normalized aerodynamic drag force of less than 1.3 lbf further reduces the drop in club head speed associated with large volume, large FB dimension golf club heads.

Figure 12:
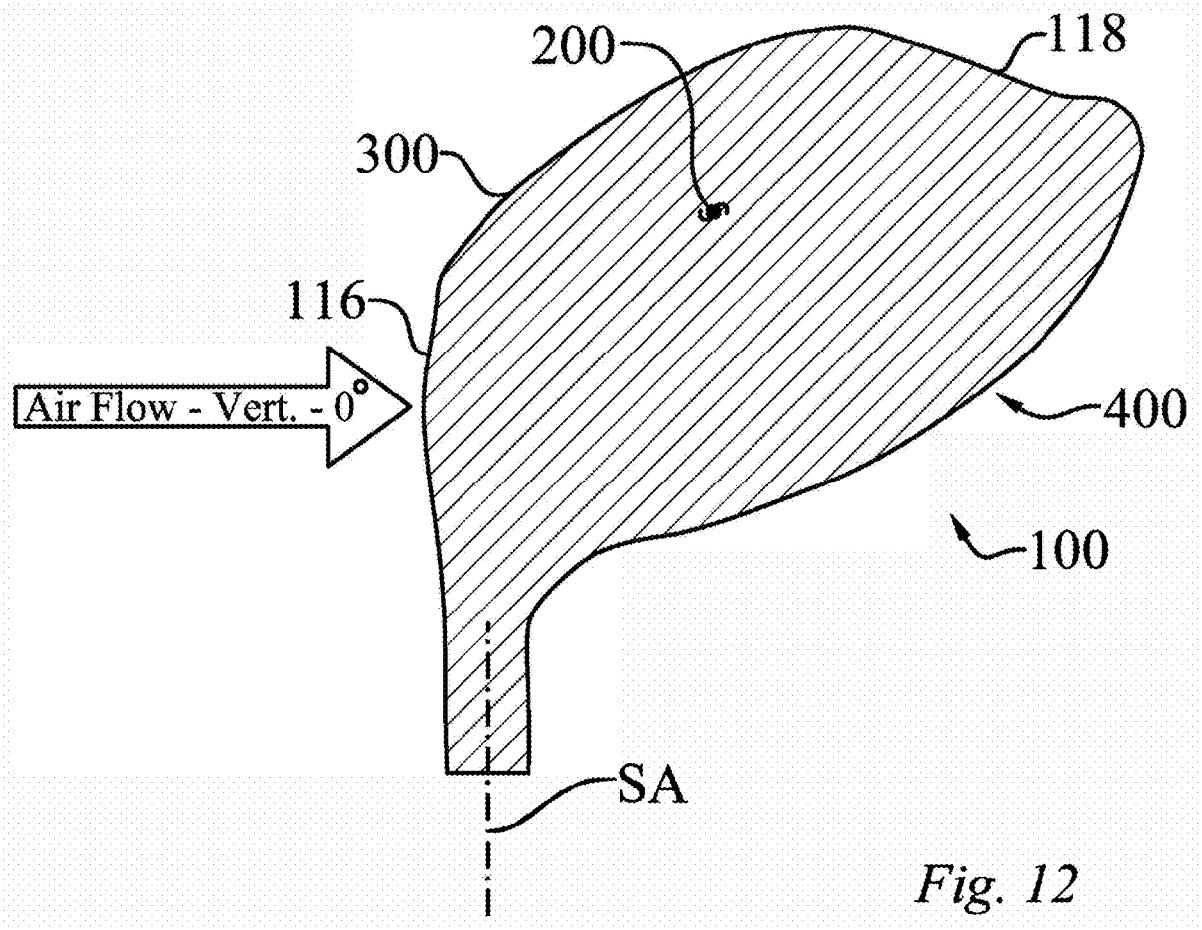
FIG. 12 shows a rotated front elevation view of a high volume aerodynamic golf club head with a vertical shaft axis orientation, not to scale.

Yet another embodiment introduces a third aerodynamic drag force, namely the heel normalized aerodynamic drag force, as previously explained with reference to FIG. 12. In this particular embodiment, the heel normalized aerodynamic drag force is less than 1.9 lbf when exposed to a horizontal 100 mph wind directed at the heel (116) with the body (110) oriented to have a vertical shaft axis (SA). In addition to having the face-on normalized aerodynamic drag force of less than 1.5 lbf and the 30 degree offset normalized aerodynamic drag force of less than 1.3 lbf, having a heel normalized aerodynamic drag force of less than 1.9 lbf further reduces the drop in club head speed associated with large volume, large FB dimension golf club heads.

A still further embodiment has recognized that having the apex-to-front radius of curvature (Ra-f) at least 25% less than the apex-to-rear radius of curvature (Ra-r) produces a particularly aerodynamic golf club head (100) further assisting in airflow reattachment and preferred airflow attachment over the crown section (400). Yet another embodiment further encourages quick airflow reattachment by incorporating an apex ratio of the apex height (AH) to the maximum top edge height (TEH) that is at least 1.2. This concept is taken even further in yet another embodiment in which the apex ratio of the apex height (AH) to the maximum top edge height (TEH) is at least 1.25. Again, these large apex ratios produce a bulbous crown section (400) that facilitates airflow reattachment as close to the face (200) as possible, thereby resulting in reduced aerodynamic drag forces and resulting in higher club head speeds.

Reducing aerodynamic drag by encouraging airflow reattachment, or conversely discouraging extended lengths of airflow separation, may be further obtained in yet another embodiment in which the apex-to-front radius of curvature (Ra-f) is less than the apex-to-rear radius of curvature (Ra-r), and the apex-to-rear radius of curvature (Ra-r) is less than the heel-to-toe radius of curvature (Rh-t). Such a shape is contrary to conventional high volume, long FB dimension golf club heads, yet produces a particularly aerodynamic shape.

Taking this embodiment a step further in another embodiment, a high volume aerodynamic golf club head (100) having the apex-to-front radius of curvature (Ra-f) less than 2.85 inches and the heel-to-toe radius of curvature (Rh-t) less than 3.85 inches produces a reduced face-on aerodynamic drag force. Another embodiment focuses on the playability of the high volume aerodynamic golf club head (100) by having a maximum top edge height (TEH) that is at least 2 inches, thereby ensuring that the face area is not reduced to an unforgiving level. Even further, another embodiment incorporates a maximum top edge height (TEH) that is at least 2.15 inches, further instilling confidence in the golfer that they are not swinging a golf club head (100) with a small striking face (200).

The foregoing embodiments may be utilized having even larger FB dimensions. For example, the previously described aerodynamic attributes may be incorporated into an embodiment having a front-to-back dimension (FB) that is at least 4.6 inches, or even further a front-to-back dimension (FB) that is at least 4.75 inches. These embodiments allow the high volume aerodynamic golf club head (100) to obtain even higher MOIy values without reducing club head speed due to excessive aerodynamic drag forces.

Yet a further embodiment balances all of the radii of curvature requirements to obtain a high volume aerodynamic golf club head (100) while minimizing the risk of an unnatural appearing golf club head by ensuring that less than 10% of the club head volume is above the elevation of the maximum top edge height (TEH). A further embodiment accomplishes the goals herein with a golf club head (100) having between 5% to 10% of the club head volume located above the elevation of the maximum top edge height (TEH). This range achieves the desired crown apex (410) and radii of curvature to ensure desirable aerodynamic drag while maintaining an aesthetically pleasing look of the golf club head (100).

The location of the crown apex (410) is dictated to a degree by the apex-to-front radius of curvature (Ra-f); however, yet a further embodiment identifies that the crown apex (410) should be behind the forwardmost point on the face (200) a distance that is a crown apex setback dimension (412), seen in FIG. 9, which is greater than 10% of the FB dimension and less than 70% of the FB dimension, thereby further reducing the period of airflow separation and resulting in desirable airflow over the crown section (400). One particular embodiment within this range incorporates a crown apex setback dimension (412) that is less than 1.75 inches. An even further embodiment balances playability with the volume shift toward the face (200) inherent in the present club head (100) by positioning the performance mass to produce a center of gravity (CG) further away from the forwardmost point on the face (200) than the crown apex setback dimension (412).

Additionally, the heel-to-toe location of the crown apex (410) also plays a significant role in the aerodynamic drag force. The location of the crown apex (410) in the heel-to-toe direction is identified by the crown apex ht dimension (414), as seen in FIG. 8. This figure also introduces a heel-to-toe (HT) dimension which is measured in accordance with USGA rules. The location of the crown apex (410) is dictated to a degree by the heel-to-toe radius of curvature (Rh-t); however, yet a further embodiment identifies that the crown apex (410) location should result in a crown apex ht dimension (414) that is greater than 30% of the HT dimension and less than 70% of the HT dimension, thereby aiding in reducing the period of airflow separation. In an even further embodiment, the crown apex (410) is located in the heel-to-toe direction between the center of gravity (CG) and the toe (118).

The present high volume aerodynamic golf club head (100) has a club head volume of at least 400 cc. Further embodiments incorporate the various features of the above described embodiments and increase the club head volume to at least 440 cc, or even further to the current USGA limit of 460 cc. However, one skilled in the art will appreciate that the specified radii and aerodynamic drag requirements are not limited to these club head sizes and apply to even larger club head volumes. Likewise, a heel-to-toe (HT) dimension of the present club head (100), as seen in FIG. 8, is greater than the FB dimension, as measured in accordance with USGA rules.

Now, turning our attention to another invention that is not limited to a "high volume" golf club head; in fact, the benefits of the present invention may be applied to drivers, fairway woods, and hybrid type golf club heads having volumes as small as 75 cc and as large as allowed by the USGA at any point in time, currently 460 cc. With reference to FIGS. 14-21, this invention is directed to an aerodynamic golf club head (100) having a trip step (500) located on the crown section (400).

As noted in the prior disclosure with reference to FIGS. 7-9, the crown section (400) has a crown apex (410) located an apex height (AH) above the ground plane (GP). As seen in FIGS. 14-19, the crown section (400) has the trip step (500) located between the crown apex (410) and the back (114). The trip step (500) is characterized by a trip step heel end (550), a trip step toe end (560), and a trip step thickness (540). Additionally, a trip step leading edge (510), located on the edge of the trip step (500) closest to the face (200), is separated from a trip step trailing edge (520), located on the edge of the trip step closest to the back (114), by a trip step width (530). The trip step leading edge (510) has a leading edge profile (512), and likewise the trip step trailing edge (520) has a trailing edge profile (522).

Figure 14:
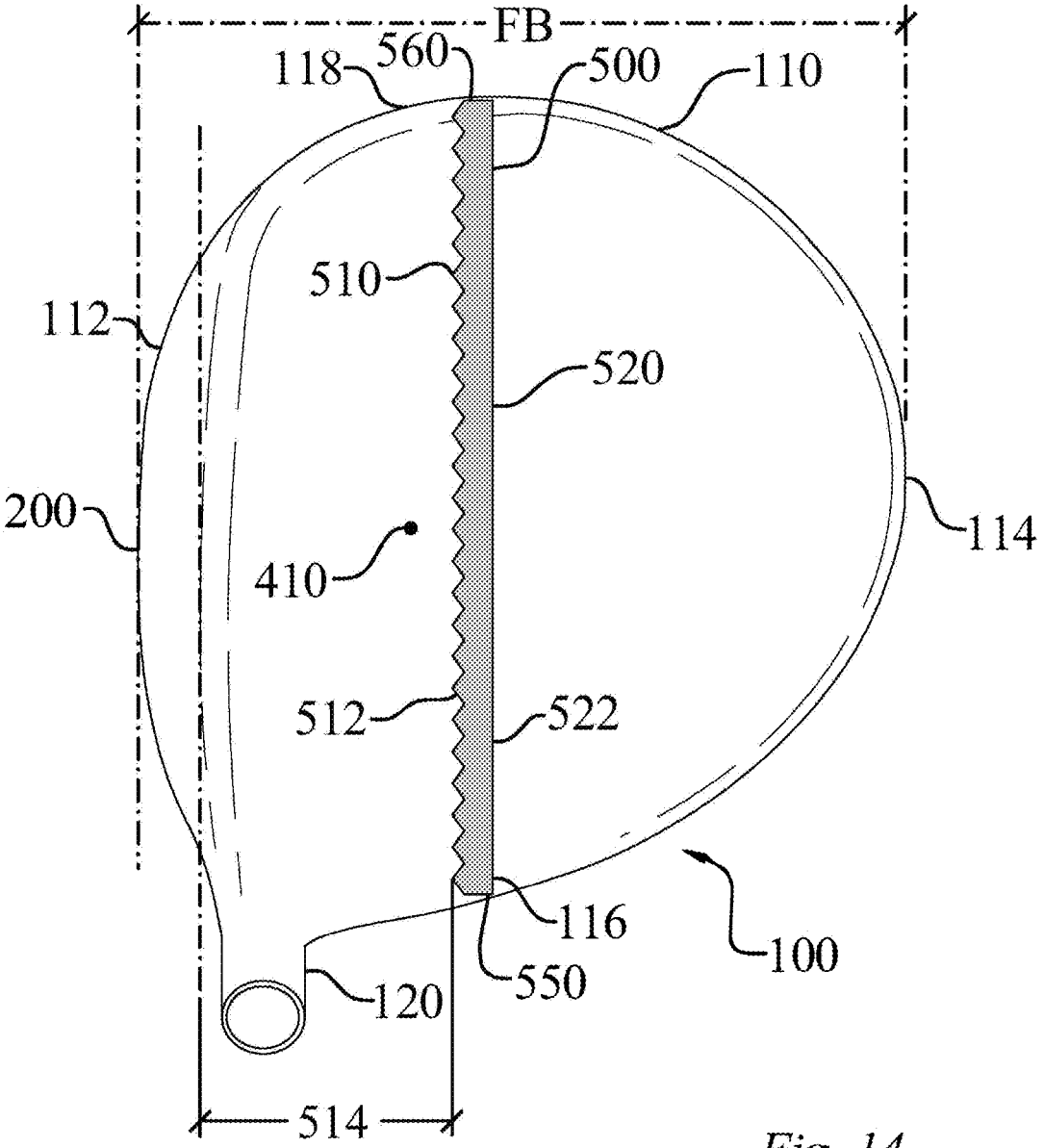
FIG. 14 shows a top plan view of an aerodynamic golf club head having a trip step of the present invention, not to scale.
Figure 15:
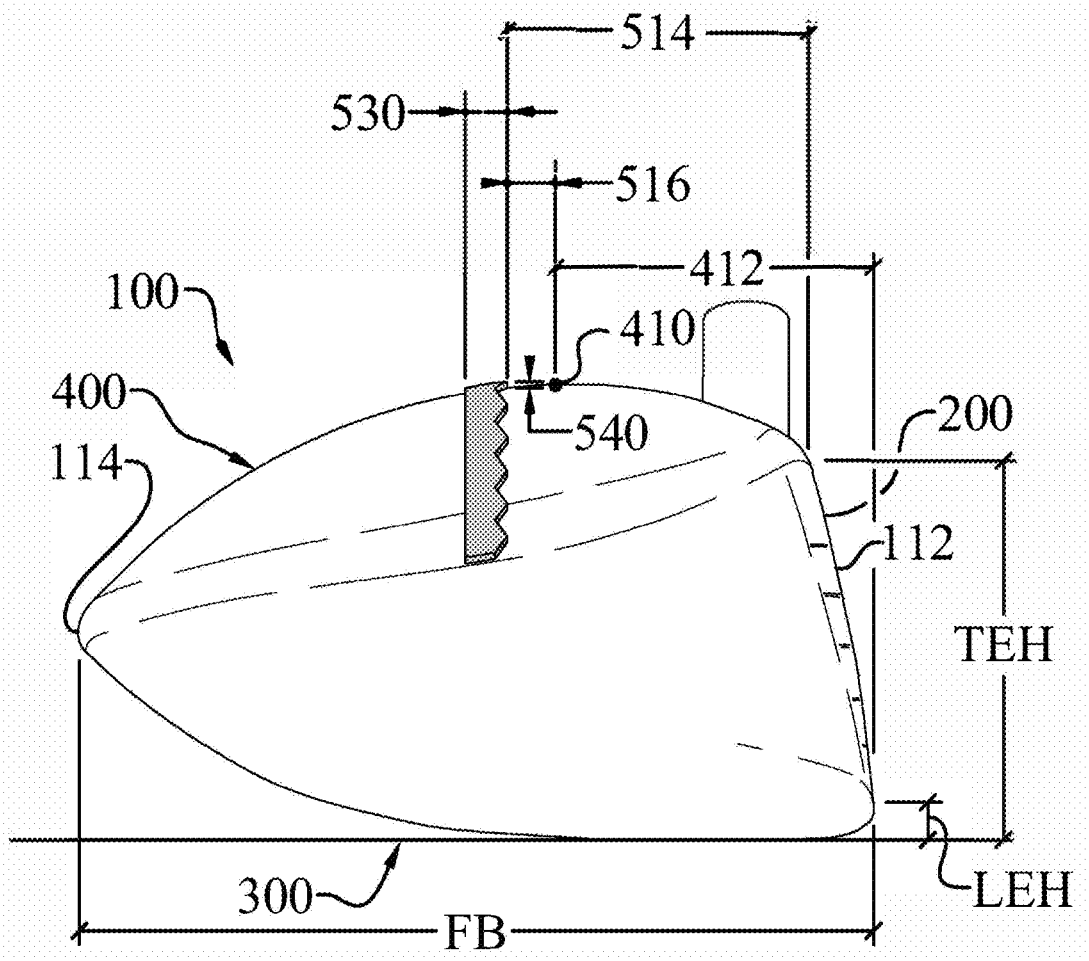
FIG. 15 shows a toe side elevation view of an aerodynamic golf club head having a trip step of the present invention, not to scale.
Figure 17:
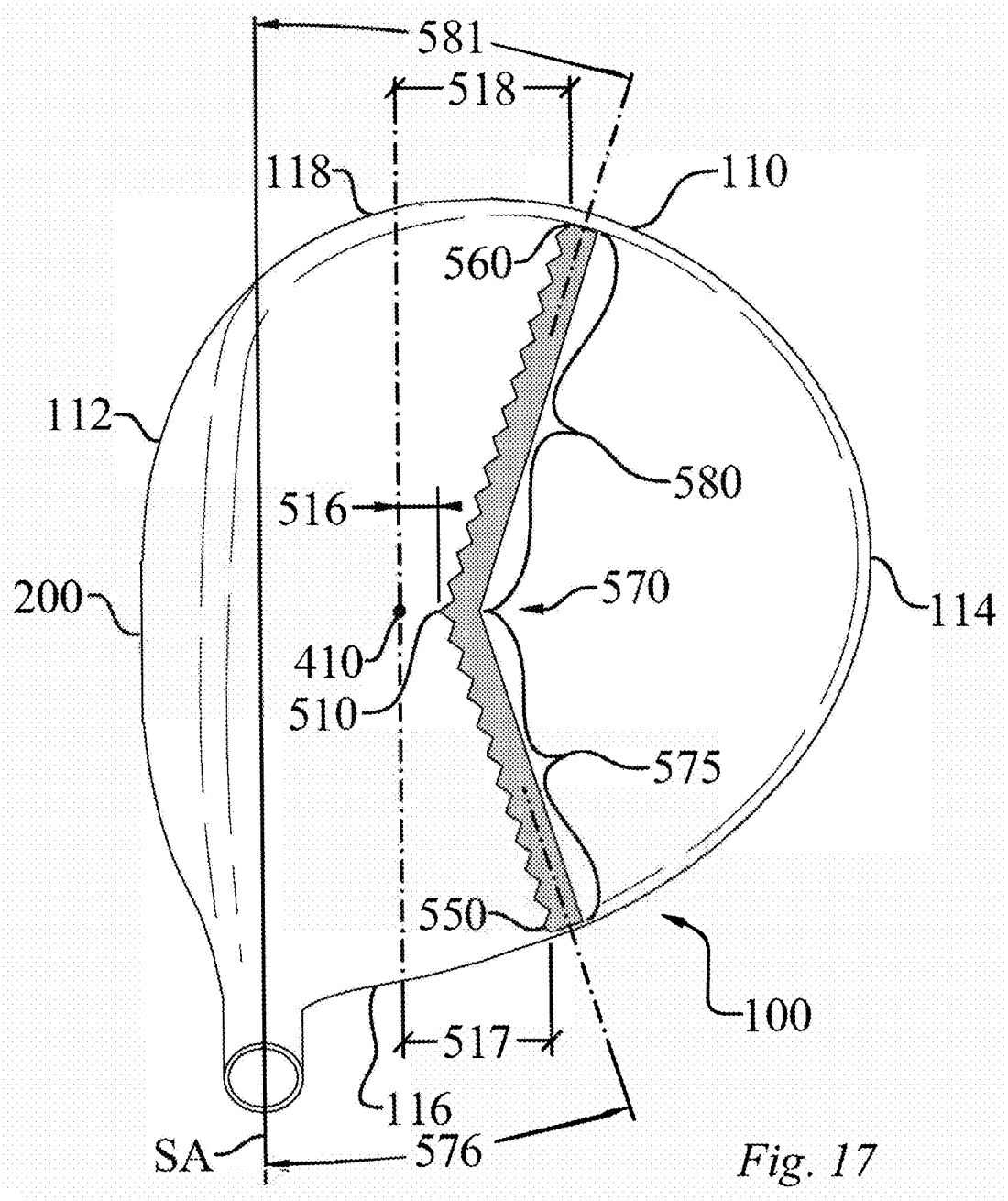
FIG. 17 shows a top plan view of an aerodynamic golf club head having a trip step of the present invention, not to scale.
Figure 19:
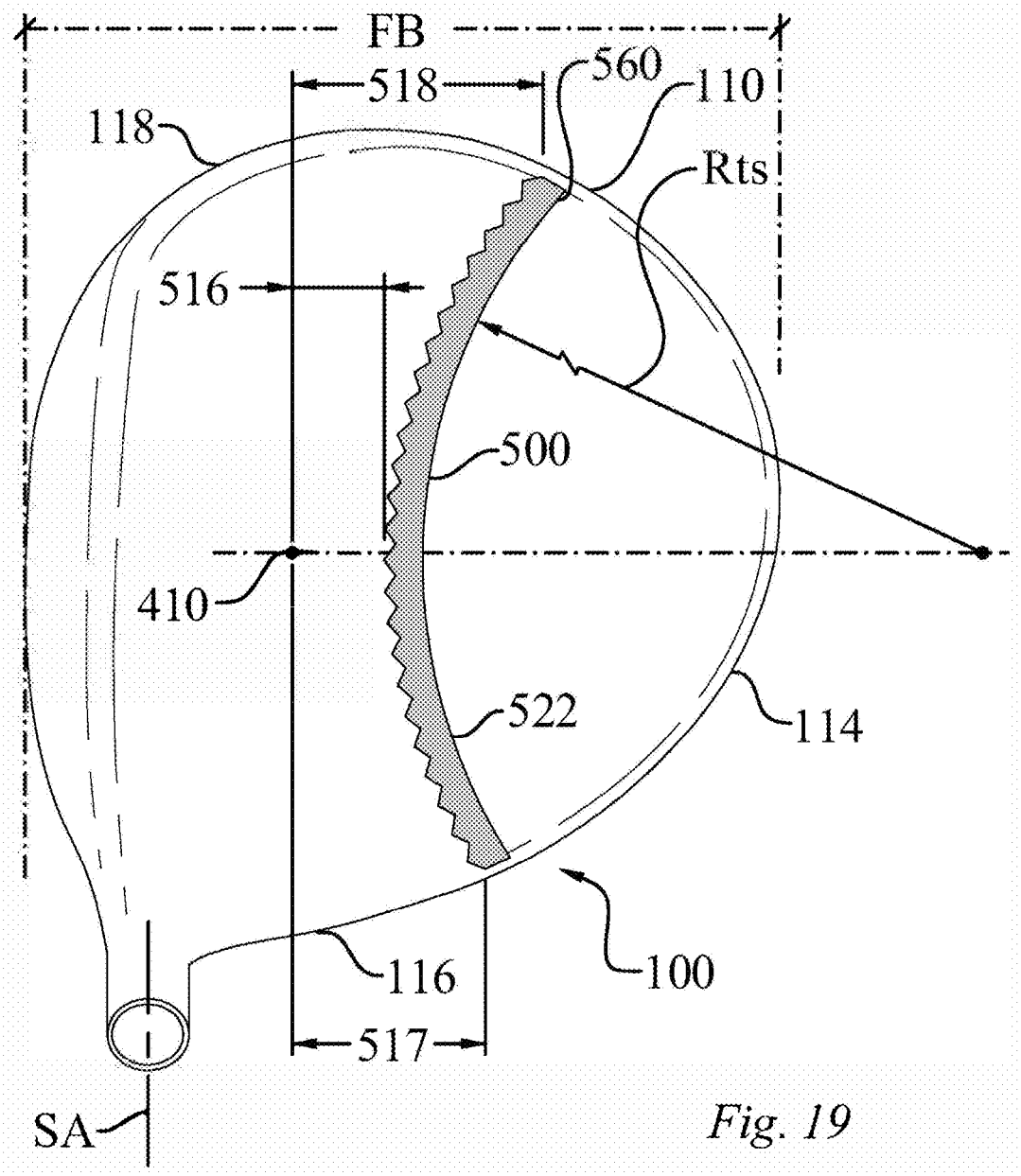
FIG. 19 shows a top plan view of an aerodynamic golf club head having a trip step of the present invention, not to scale.

As previously mentioned, the trip step (500) is located between the crown apex (410) and the back (114); as such, several elements are utilized to identify the location of the trip step (500). As seen in FIGS. 14 and 15, the trip step leading edge (510) is located a trip step offset (514) behind the face top edge (210) in a direction perpendicular to a vertical plane through the shaft axis (SA). Further, as seen in FIG. 15, the trip step (500) conforms to the curvature of the crown section (400) and is located behind the crown apex (410) an apex-to-leading edge offset (516), also measured in a direction perpendicular to a vertical plane through the shaft axis (SA). Additionally, as seen in FIGS. 17 and 19, the trip step leading edge (510) at the trip step heel end (550) is located behind the crown apex (410) an apex-to-heel LE offset (517), and likewise, the trip step leading edge (510) at the trip step toe end (560) is located behind the crown apex (410) an apex-to-toe LE offset (518). Thus, in the straight-line embodiment of FIGS. 14-15 the apex-to-heel LE offset (517) and the apex-to-toe LE offset (518) are equal to the apex-to-leading edge offset (516).

Figure 20:
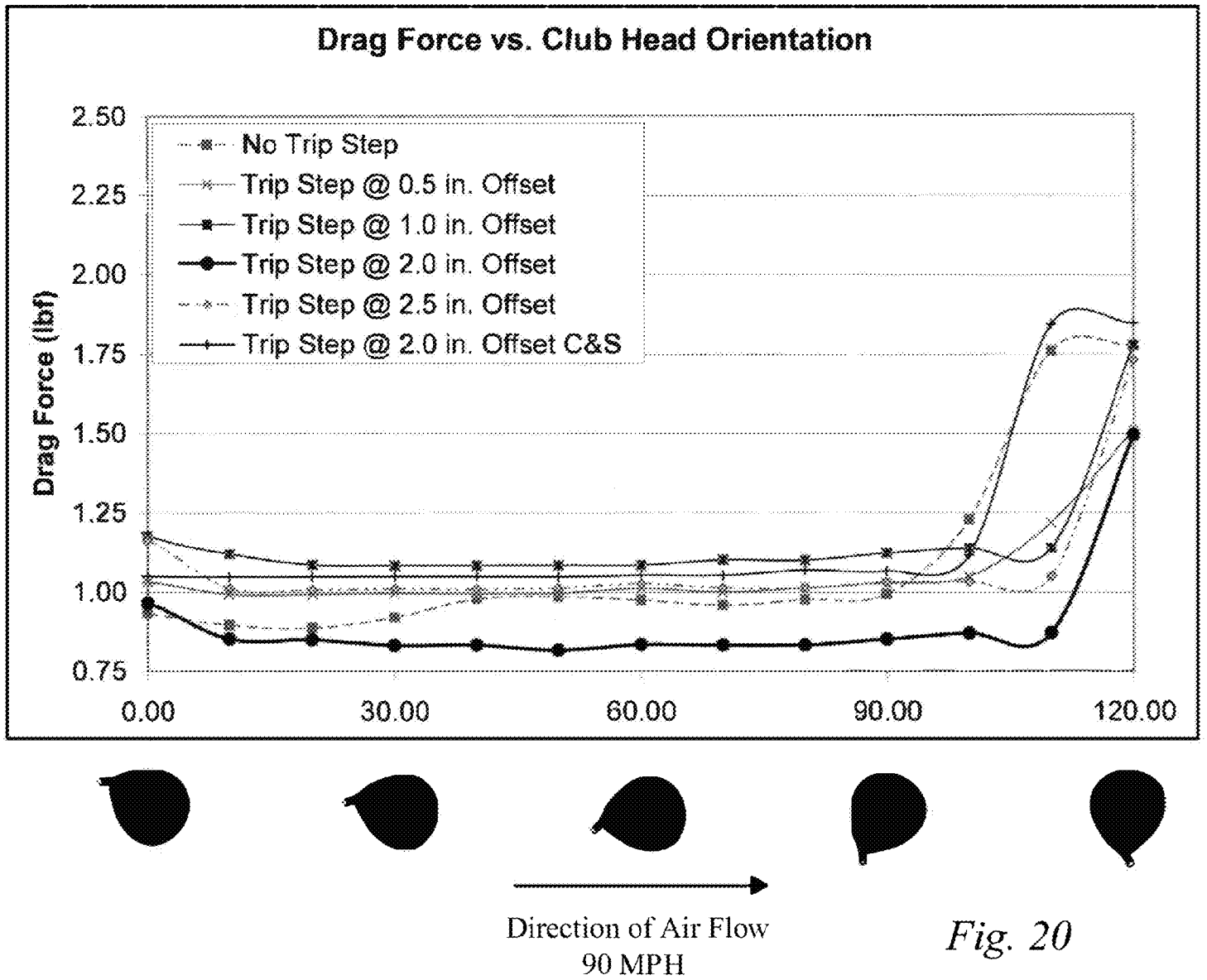
FIG. 20 shows a graph of aerodynamic drag force versus club head orientation for six different configurations at 90 miles per hour.

The trip step (500) enables significant reduction in the aerodynamic drag force exerted on the aerodynamic golf club head (100) of the present invention. For instance, FIG. 20 is a graph illustrating the aerodynamic drag force measured when a golf club head is exposed to a 90 mph wind in various positions. The graph illustrates the results for the high volume aerodynamic golf club head (100) previously described without a trip step, compared to the same club head with a trip step (500) located at various positions on the crown section (400). The "offset" referred to in the legend of FIG. 20 is the trip step offset (514) seen in FIG. 15. Thus, experiments were performed and data was gathered for each club head variation at thirteen different orientations from 0 degrees to 120 degrees, in 10 degree increments. The orientations and associated wind direction have been previously touched on and will not be revisited here.

The graph of FIG. 20 clearly illustrates that the lowest aerodynamic drag was achieved when the trip step (500) was located with a two inch trip step offset (514). In fact, the zero degree orientation was the only position in which the aerodynamic drag of the two inch trip step offset (514) was not the lowest of all six variations. The two inch trip step offset (514) is unique in that all the other trip step (500) locations actually produced increased aerodynamic drag at over 80 percent of the orientations when compared to the non-trip step club head.

Interestingly, the final entry in the graph legend of FIG. 20 is "Trip Step @ 2.0 in. Offset C&S" and line representing this variation produced the second worst aerodynamic drag force numbers. In this variation the "C&S" language refers to "crown" and "sole." Thus, the two inch trip step offset (514) that greatly reduced the aerodynamic drag force when applied to the crown section (400) actually significantly increased the aerodynamic drag force when the trip step (500) was also applied to the sole section (300) of the club head.

The present invention has uniquely identified the window of opportunity to apply a trip step (500) and obtain reduced aerodynamic drag force. The trip step (500) must be located behind the crown apex (410). Further, specific locations, shapes, and edge profiles provide preferred aerodynamic results. The present invention provides an aerodynamic golf club head (100) has a face-on aerodynamic drag force of less than 1.0 lbf when exposed to a 90 mph wind parallel to the ground plane (GP) when the aerodynamic golf club head (100) is positioned in a design orientation and the wind is oriented at the front (112) of the aerodynamic golf club head (100). In a further embodiment the aerodynamic drag force is less than 1.0 lbf throughout the orientations from 0 degrees up to 110 degrees. In yet another embodiment the aerodynamic drag force is 0.85 lbf or less throughout the orientation of 10 degrees up to 90 degrees. Still further, the two inch trip step offset (514) of FIG. 20 reduced the aerodynamic drag force on average approximately fifteen percent over the club without a trip step throughout the orientation range of 30 degrees up to 90 degrees, conversely every other trip step (500) location increased the aerodynamic drag force throughout this orientation range.

Figure 21:
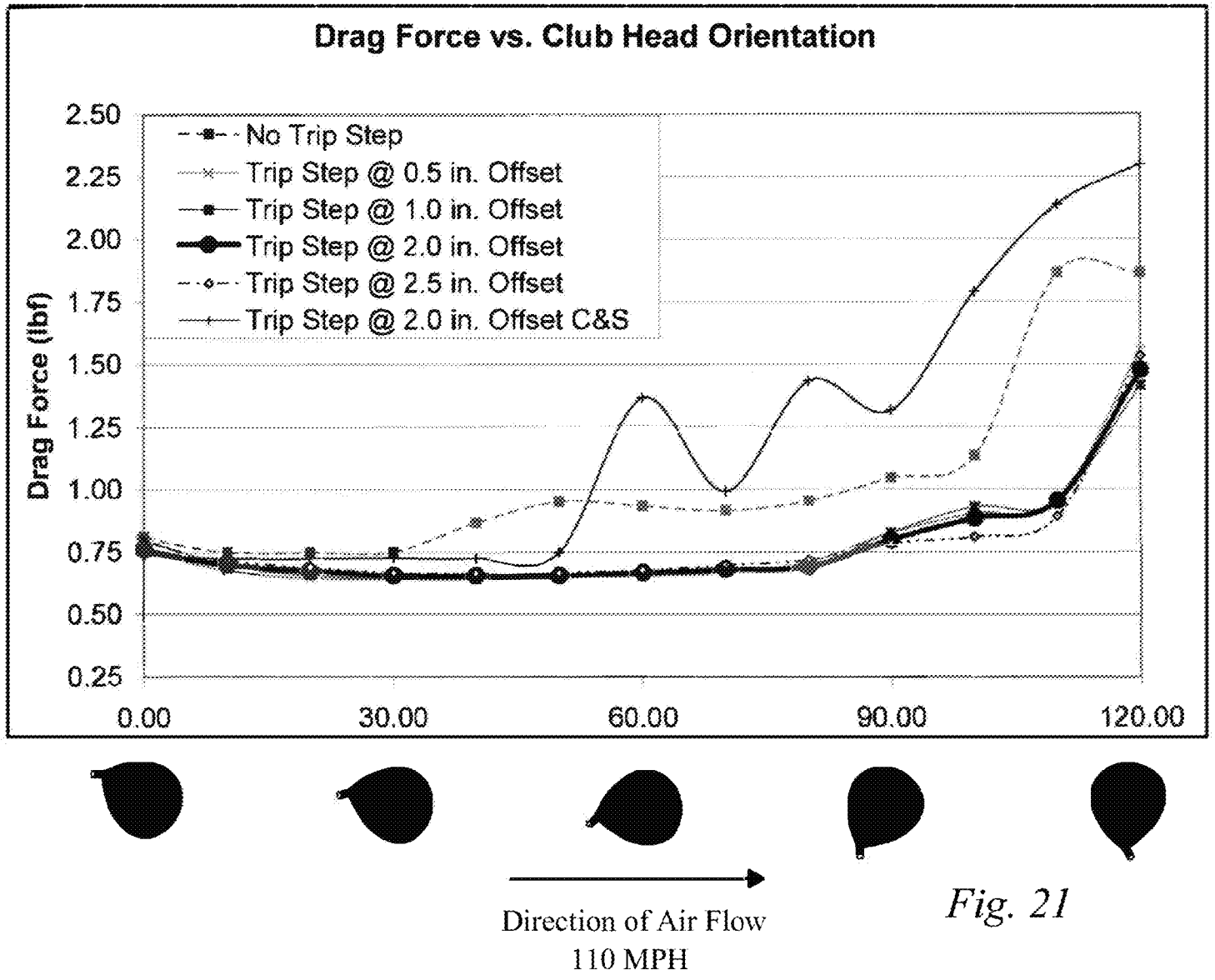
FIG. 21 shows a graph of aerodynamic drag force versus club head orientation for six different configurations at 110 miles per hour.

At a higher wind speed of 110 mph, seen in FIG. 21, all of the crown only trip step (500) embodiments reduced the aerodynamic drag force compared to the non-trip step club. At the higher wind speed the reduction in aerodynamic drag force is even more significant than at the 90 mph wind speed throughout majority of the orientations. However, the large variations in the aerodynamic drag force associated with various trip step (500) locations is greatly reduced. Since most golfers swing their fairway woods and hybrid type clubs at 80-90 percent of their driver swing speed, FIG. 20 illustrates that the present invention is particularly effective at reducing aerodynamic drag force at lower wind speeds making it ideal for fairway woods and hybrid type golf clubs, as well as drivers. Thus, the present invention is not limited to high volume golf club heads.

The trip step thickness (540), seen in FIG. 15, is preferably less than 1/16 inch. In one particular embodiment the trip step (500) is positioned such that the greatest elevation of the trip step (500) above the ground plane (GP) is less than the apex height (AH), thus the trip step (500) is not visible from a front on face elevation view. The trip step (500) forces the air passing over the aerodynamic club head (100) from laminar flow to turbulent flow just before the separation point. This selectively engineered transition from laminar to turbulent flow over the crown section (400) slightly increases the skin friction but causes less drag than if the air were to detach from the face (200).

In yet another embodiment the lineal length of the trip step (500) is greater than seventy-five percent of the heel-to-toe dimension (HT). This length of trip step (500) causes the laminar to turbulent transition over enough of the crown section (400) to achieve the desired reduction in aerodynamic drag force. Further, in another embodiment the trip step (500) is continuous and uninterrupted. An even further embodiment with a bulbous crown section (400) incorporates a trip step (500) in which the lineal length of the trip step (500) is greater than the heel-to-toe dimension (HT). However, even in this embodiment the trip step (500) is limited to the crown section (400).

Figure 22:
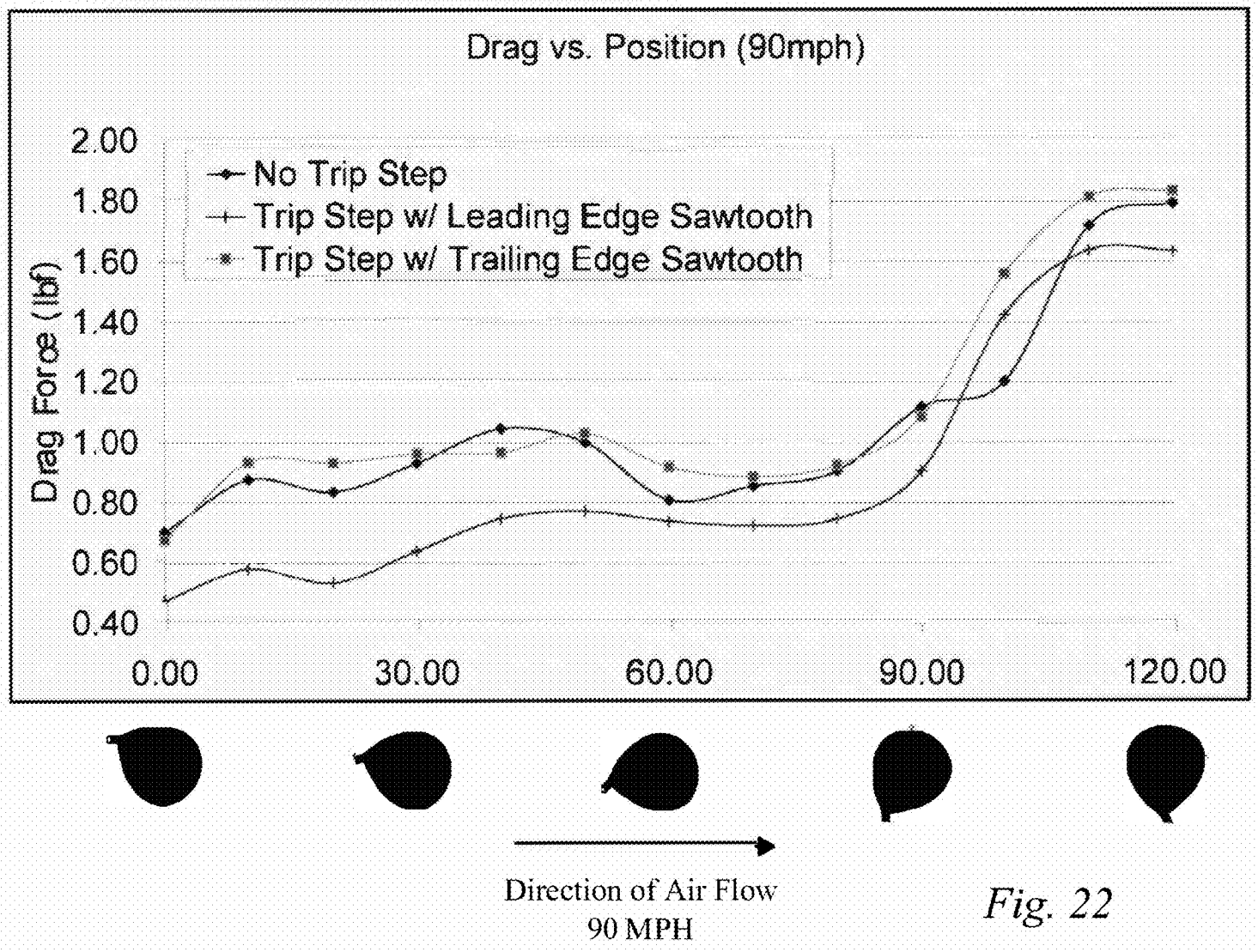
FIG. 22 shows a graph of aerodynamic drag force versus club head orientation for six different configurations at 90 miles per hour.

The leading edge profile (512) of the trip step (500) may be virtually any configuration. Further, the trip step leading edge (510) does not have to be parallel to the trip step trailing edge (520), thus the trip step width (530) may be variable. In one particular embodiment the leading edge profile (512) includes a sawtooth pattern to further assist in the transition from laminar to turbulent flow. The sawtooth leading edge profile (512) seen in FIGS. 14-19, creates vortices promoting separation at the desired locations. The graph of FIG. 22 illustrates that a sawtooth leading edge profile (512) significantly reduces the aerodynamic drag forces, while a similar pattern on the trailing edge profile (522) has minimal impact on the aerodynamic drag forces throughout the orientations. Close comparison of the "No Trip Step" curve and the "Trip Step w/Leading Edge Sawtooth" curve illustrate an approximately 24% reduction in aerodynamic drag force for the positions ranging from zero degrees to ninety degrees.

Further, a trip step width (530) of 1/4 inch or less produces the desired air flow transition. Still further, one embodiment has found that a trip step width (530) of less than the apex-to-leading edge offset (516) produces preferred transition characteristics. The trip step width (530) does not have to be uniform across the entire length of the trip step (500).

Yet another embodiment has an apex-to-leading edge offset (516), seen best in FIG. 15, of less than fifty percent of the crown apex setback dimension (412), seen in FIG. 14, thereby further promoting the transition from laminar to turbulent flow. An even further embodiment narrows the preferred apex-to-leading edge offset (516) range to also being at least ten percent of the crown apex setback dimension (412). Thus, in this one of many embodiments, the preferred location for the trip step (500) has an apex-to-leading edge offset (516) that is ten to fifty percent of the crown apex setback dimension (412).

While the trip step (500) of FIG. 14 is a single straight trip step (500) with the trip step leading edge (510) parallel to a vertical plane through the shaft axis (SA); the trip step (500) may include several distinct sections. For example, the trip step (500) of FIG. 17 is a multi-sectional trip step (570) having at least a heel oriented trip step section (575) and a toe oriented trip step section (580). In this embodiment the forward most point of the trip step (500) is located behind the crown apex (410) and each section (575, 580) angles back from this forward most point. The heel oriented trip step section (575) diverges from a vertical plane passing through the shaft axis at a heel section angle (576), and likewise the toe oriented trip step section (580) diverges from a vertical plane passing through the shaft axis at a toe section angle (581). The measurement of these angles (576, 581) can be thought of as the projection of the trip step (500) directly vertically downward onto the ground plane (GP) with the angle then measured along the ground plane (GP) from the vertical plane passing through the shaft axis. One particular embodiment reduces aerodynamic drag force with a design in which the heel oriented trip step section (575) forms a heel section angle (576) of at least five degrees, and the toe oriented trip step section (580) forms a toe section angle (581) of at least five degrees.

The introduction of the multi-sectional trip step (570) affords numerous embodiments of the present invention. One particular embodiment simply incorporates a design in which aerodynamic drag force is reduced by incorporating a trip step (500) that has an apex-to-heel LE offset (517) that is greater than the apex-to-leading edge offset (516), and an apex-to-toe LE offset (518) that is greater than the apex-to-leading edge offset (516), which is true of the embodiment seen in FIG. 17. In yet another embodiment the relationships just described are taken even further. In fact, in this embodiment the apex-to-heel LE offset (517) is at least fifty percent greater than the apex-to-leading edge offset (516), and the apex-to-toe LE offset (518) is at least fifty percent greater than the apex-to-leading edge offset (516)

Another embodiment of the multi-sectional trip step (570) variation incorporates a face oriented trip step section (585) that is parallel to the vertical plane passing through the shaft axis (SA). Thus, this embodiment incorporates a section (585) that is essentially parallel to the face (200), and a section that is not. Such embodiments capitalize on the fact that during a golf swing air does not merely pass over the crown section (400) from the face (200) to the back (114) in a straight manner. In fact, a large portion of the swing is occupied with the golf club head (100) slicing through the air being led by the hosel (120), or the heel (116) side of the club. That said, reducing the face-on aerodynamic drag force, also referred to as the "Air Flow—90°" orientation of FIG. 11, plays a significant role in reducing the aerodynamic drag forces that prevent a golfer from obtaining a higher swing speed. One particular embodiment takes advantage of this discovery by ensuring that the lineal length of the face oriented trip step section (585) is greater than fifty percent of the heel-to-toe dimension (HT).

Figure 16:
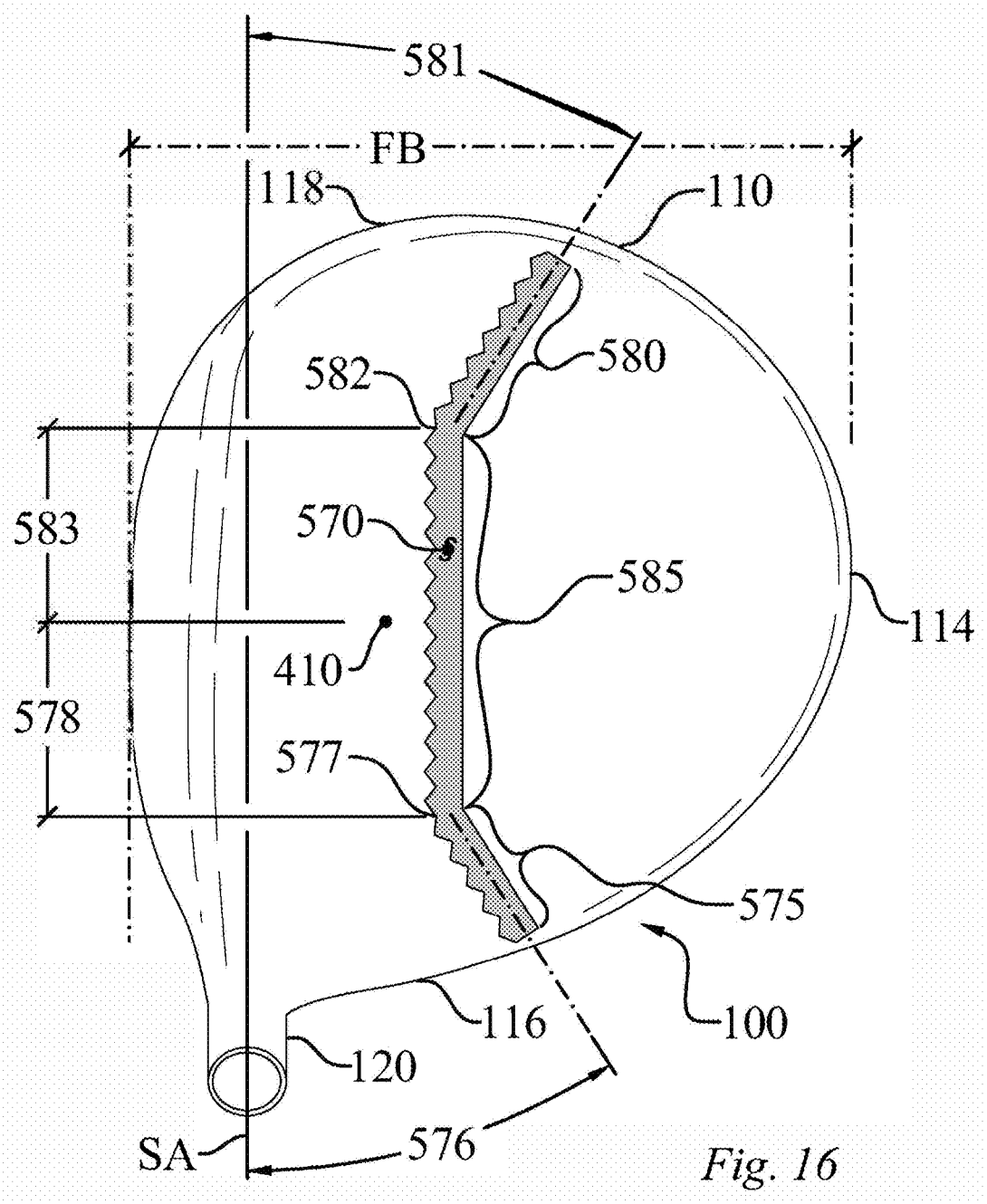
FIG. 16 shows a top plan view of an aerodynamic golf club head having a trip step of the present invention, not to scale.

Yet another embodiment, seen in FIG. 16, incorporates a heel oriented trip step section (575), a toe oriented trip step section (580), and a face oriented trip step section (585). This embodiment has a heel trip step transition point (577) delineating the heel oriented trip step section (575) from the face oriented trip step section (585). Likewise, a toe trip step transition point (582) delineates the toe oriented trip step section (580) from the face oriented trip step section (585). The location of these transition points (577, 582) are identified via a heel transition point offset (578) and a toe transition point offset (583), both seen in FIG. 16. These are distances measured from the crown apex (410) to the locations of the transition points (577, 582) in a direction parallel to a vertical plane passing through the shaft axis (SA). In this particular embodiment it is preferred to have the heel transition point offset (578) greater than the apex-to-heel leading edge offset (517) seen in FIG. 17. Similarly, in this embodiment it is preferred to have the toe transition point offset (583) greater than the toe-to-heel leading edge offset (518) seen in FIG. 18. This unique relationship recognizes the importance of reducing the face-on aerodynamic drag force, also referred to as the "Air Flow—90°" orientation of FIG. 11, while not ignoring the desire to reduce the aerodynamic drag force in other orientations.

Figure 18:
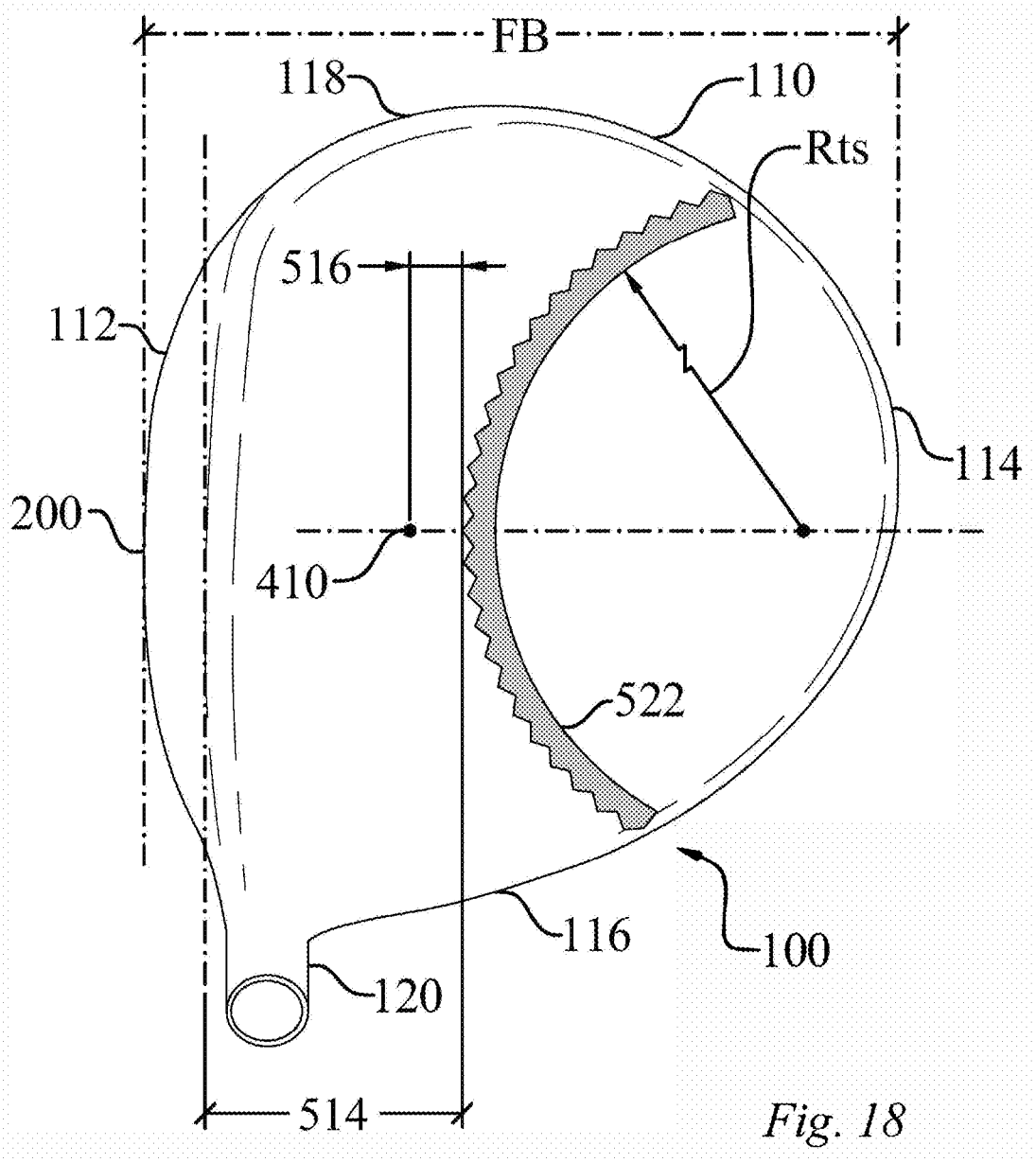
FIG. 18 shows a top plan view of an aerodynamic golf club head having a trip step of the present invention, not to scale.

Another embodiment directed to the achieving a preferential balance of reducing the aerodynamic drag force in multiple orientations incorporates a curved trip step (500), as seen in FIGS. 18 and 19. The curve of the curved trip step (500) is defined by a vertical projection of the curved trip step (500) onto the ground plane (GP). Then, this translated projection of the outline of the curved trip step (500) may be identified as having at least one trip step radius of curvature (Rts). Preferred reduction in the aerodynamic drag force is found when the center of the trip step radius of curvature (Rts) is behind the crown apex (410) and the trip step radius of curvature (Rts) is greater than the apex-to-front radius of curvature (Ra-f), seen in FIG. 9. Further, yet another embodiment incorporates a trip step radius of curvature (Rts) that is less than the bulge of the face (200). An even further embodiment incorporates a trip step radius of curvature (Rts) that is less than the roll of the face (200). One particular embodiment used to produce the data seen in FIG. 22 offered a tremendously beneficial reduction in aerodynamic drag force by incorporating a trip step radius of curvature (Rts) that is greater than the apex-to-front radius of curvature (Ra-f), seen in FIG. 9, while having a trip step radius of curvature (Rts) that is less than both the bulge and the roll of the face (200). This newly developed range tends to result in a trip step (500) curvature that mimics the natural curvature of the air flow separation on crown of a golf club head.

Yet another embodiment places the trip step (500) at, or slightly in front of, the natural location of air flow separation on the club head without the trip step (500). Thus, wind tunnel testing can be performed to visually illustrate the natural air flow separation pattern on the crown of a particular golf club head design. Then, a curved trip step (500) may be applied to a portion of the crown section (400) at the natural air flow separation curve, or slightly forward of the natural air flow separation curve in a direction toward the face (200). Thus, in this embodiment, seen in FIG. 19, a curved trip step (500) extends over a portion of the crown section (400) from a location behind the crown apex (410) and extending toward the toe (118). In this embodiment the curved trip step (500) curves from a forward most point behind the crown apex (410) to a most rearward point at the trip step toe end (560). In one particular embodiment preferred aerodynamic performance was achieved when the apex-to-toe LE offset (518) is greater than the apex-to-leading edge offset (516). Even further reduction in aerodynamic drag force is achieved when the apex-to-toe LE offset (518) is at least fifty percent greater than the apex-to-leading edge offset (516).

The curved trip step (500) does not need to be one continuous smooth curve. In fact, the curved trip step (500) may be a compound curve. Further, as previously mentioned, the curved trip step (500) is not required to extend toward the heel (116) of the golf club because the disruption in the air flow pattern caused by the hosel results in turbulent air flow near the heel (116), and thus it is unlikely a reduction in aerodynamic drag force is achieved by extending the curved trip step (500) all the way to the heel (116). However, the aesthetically pleasing embodiment of FIG. 19 incorporates a relatively symmetric curved trip step (500) so that it is not distracting to the golfer. Thus, in this one embodiment the apex-to-heel LE offset (517) is greater than the apex-to-leading edge offset (516), and the apex-to-toe LE offset (518) is greater than the apex-to-leading edge offset (516).

All of the previously described aerodynamic characteristics with respect to the crown section (400) apply equally to the sole section (300) of the high volume aerodynamic golf club head (100). In other words, one skilled in the art will appreciate that just like the crown section (400) has a crown apex (410), the sole section (300) may have a sole apex. Likewise, the three radii of the crown section (400) may just as easily be three radii of the sole section (300). Thus, all of the embodiments described herein with respect to the crown section (400) are incorporated by reference with respect to the sole section (300).

The various parts of the golf club head (100) may be made from any suitable or desired materials without departing from the claimed club head (100), including conventional metallic and nonmetallic materials known and used in the art, such as steel (including stainless steel), titanium alloys, magnesium alloys, aluminum alloys, carbon fiber composite materials, glass fiber composite materials, carbon pre-preg materials, polymeric materials, and the like. The various sections of the club head (100) may be produced in any suitable or desired manner without departing from the claimed club head (100), including in conventional manners known and used in the art, such as by casting, forging, molding (e.g., injection or blow molding), etc. The various sections may be held together as a unitary structure in any suitable or desired manner, including in conventional manners known and used in the art, such as using mechanical connectors, adhesives, cements, welding, brazing, soldering, bonding, and other known material joining techniques. Additionally, the various sections of the golf club head (100) may be constructed from one or more individual pieces, optionally pieces made from different materials having different densities, without departing from the claimed club head (100).

Numerous alterations, modifications, and variations of the preferred embodiments disclosed herein will be apparent to those skilled in the art and they are all anticipated and contemplated to be within the spirit and scope of the instant club head. For example, although specific embodiments have been described in detail, those with skill in the art will understand that the preceding embodiments and variations can be modified to incorporate various types of substitute and or additional or alternative materials, relative arrangement of elements, and dimensional configurations. Accordingly, even though only few variations of the present club head are described herein, it is to be understood that the practice of such additional modifications and variations and the equivalents thereof, are within the spirit and scope of the club head as defined in the following claims. The corresponding structures, materials, acts, and equivalents of all means or step plus function elements in the claims below are intended to include any structure, material, or acts for performing the functions in combination with other claimed elements as specifically claimed.

We claim:

1. A high volume aerodynamic golf club head (100) comprising:

A) a body (110) having a club head volume of at least 400 cc, a face (200), a sole section (300), a crown section (400) having a fiber composite material crown portion, a front (112), a back (114), a heel (116), a toe (118), and a center of gravity (CG), wherein the body (110) has a front-to-back dimension (FB) of at least 4.4 inches;

B) the face (200) having a top edge (210) and a lower edge (220), wherein a top edge height (TEH) is the elevation of the top edge (210) above a ground plane (GP), and a lower edge height (LEH) is the elevation of the lower edge (220) above the ground plane (GP), wherein a maximum top edge height (TEH) is at least 2 inches; and C) the fiber composite material crown portion having a crown apex (410) located an apex height (AH) above a ground plane (GP), wherein:

(i) within a front-to-back vertical section through the crown apex (410) and perpendicular to a vertical plane created by a shaft axis (SA), a portion of the crown section (400) between the crown apex (410) and the face (200) has an apex-to-front radius of curvature (Ra-f);

(ii) within a heel-to-toe vertical section parallel to the vertical plane created by the shaft axis (SA), a portion of the crown section (400), above the elevation of the maximum top edge height (TEH), has a heel-to-toe radius of curvature (Rh-t), and the heel-to-toe radius of curvature (Rh-t) in contact with the crown apex (410) is less than 4 inches;

(iii) within the front-to-back vertical section a portion of the crown section (400), above the elevation of the maximum top edge height (TEH), between the crown apex (410) and the back (114) has an apex-to-rear radius of curvature (Ra-r);

(iv) wherein the apex-to-front radius of curvature (Ra-f) at the crown apex (410) is at least 25% less than the greatest apex-to-rear radius of curvature (Ra-r) of the portion of the fiber composite material crown portion within the front-to-back vertical section;

(v) the crown apex (410) is behind the forwardmost point on the face (200) a crown apex setback dimension (412), and the crown apex setback dimension (412) is less than a CG depth distance that is parallel to the crown apex setback dimension (412) and measured from a vertical projection of the center of gravity (CG) on the ground plane (GP) to a vertical projection of the forwardmost point on the face (200) on the ground plane (GP); and (vi) the crown apex (410) is located between the toe (118) and a vertical front-to-back plane through the center of gravity (CG);

D) the high volume aerodynamic golf club head (100) has:

(i) a first moment of inertia (MOIy) about a vertical axis through a center of gravity (CG) of the high volume aerodynamic golf club head (100) that is at least 4000 g*cm$^2$; and (ii) a second moment of inertia (MOIx) about a horizontal axis through the center of gravity (CG) that is at least 2000 g*cm$^2$.

2. The high volume aerodynamic golf club head (100) of claim 1, wherein the front-to-back dimension (FB) is at least 4.6 inches, the club head volume is at least 440 cc, and the crown apex setback dimension (412) is less than 1.75 inches.

3. The high volume aerodynamic golf club head (100) of claim 1, wherein the heel-to-toe radius of curvature (Rh-t) in contact with the crown apex (410) is less than 3.85 inches, and the front-to-back dimension (FB) is at least 4.6 inches.

4. The high volume aerodynamic golf club head (100) of claim 1, wherein the apex-to-front radius of curvature (Ra-f) in contact with the crown apex (410) is less than a heel-to-toe radius of curvature (Rh-t) in contact with the crown apex (410).

5. The high volume aerodynamic golf club head (100) of claim 1, wherein an apex ratio of the apex height (AH) to the greatest top edge height (TEH) is at least 1.13, the front-to-back dimension (FB) is at least 4.6 inches, and the club head volume is at least 440 cc.

6. The high volume aerodynamic golf club head (100) of claim 1, wherein the apex-to-front radius of curvature (Ra-f) at the crown apex (410) is less than 3 inches, the front-to-back dimension (FB) is at least 4.75 inches, and the club head volume is at least 440 cc.

7. The high volume aerodynamic golf club head (100) of claim 1, wherein the front-to-back dimension (FB) is at least 4.75 inches, the club head volume is at least 440 cc, and an apex ratio of the apex height (AH) to the greatest top edge height (TEH) is at least 1.13.

8. The high volume aerodynamic golf club head (100) of claim 1, wherein the front-to-back dimension (FB) is at least 4.75 inches, the body (100) is formed of a plurality of individual pieces, and at least one of the individual pieces is formed of aluminum alloy.

9. The high volume aerodynamic golf club head (100) of claim 8, wherein the sole section (300) includes a fiber composite material sole portion.

10. The high volume aerodynamic golf club head (100) of claim 9, wherein the fiber composite material sole portion is adhesively attached to the at least one aluminum alloy component.

11. The high volume aerodynamic golf club head (100) of claim 8, wherein the face (200) includes a nonmetallic face portion.

12. The high volume aerodynamic golf club head (100) of claim 11, wherein the nonmetallic face portion is adhesively attached to the at least one aluminum alloy component.

13. The high volume aerodynamic golf club head (100) of claim 8, wherein the face (200) includes a titanium alloy face portion.

14. The high volume aerodynamic golf club head (100) of claim 13, wherein the titanium alloy face portion is adhesively attached to the at least one aluminum alloy component.

15. A high volume aerodynamic golf club head (100) comprising:

A) a body (110) having a club head volume of at least 400 cc, a face (200), a sole section (300), a crown section (400) having a fiber composite material crown portion, a front (112), a back (114), a heel (116), a toe (118), and a center of gravity (CG), wherein the body (110) has a front-to-back dimension (FB) of at least 4.4 inches;

B) the face (200) having a top edge (210) and a lower edge (220), wherein a top edge height (TEH) is the elevation of the top edge (210) above a ground plane (GP), and a lower edge height (LEH) is the elevation of the lower edge (220) above the ground plane (GP), wherein a maximum top edge height (TEH) is at least 2 inches; and C) the fiber composite material crown portion having a crown apex (410) located an apex height (AH) above a ground plane (GP), wherein:

(i) within a front-to-back vertical section through the crown apex (410) and perpendicular to a vertical plane created by a shaft axis (SA), a portion of the crown section (400) between the crown apex (410) and the face (200) has an apex-to-front radius of curvature (Ra-f);

(ii) within a heel-to-toe vertical section parallel to the vertical plane created by the shaft axis (SA), a portion of the crown section (400), above the elevation of the maximum top edge height (TEH), has a heel-to-toe radius of curvature (Rh-t), and the heel-to-toe radius of curvature (Rh-t) in contact with the crown apex (410) is less than 4 inches;

(iii) within the front-to-back vertical section a portion of the crown section (400), above the elevation of the maximum top edge height (TEH), between the crown apex (410) and the back (114) has an apex-to-rear radius of curvature (Ra-r);

(iv) wherein the apex-to-front radius of curvature (Ra-f) at the crown apex (410) is less than the greatest apex-to-rear radius of curvature (Ra-r) of the portion of the fiber composite material crown portion within the front-to-back vertical section;

(v) the crown apex (410) is located at a crown apex HT dimension (414) that is greater than 30% of the heel-to-toe dimension (HT) and less than 70% of the heel-to-toe dimension (HT);

(vi) the crown apex (410) is behind the forwardmost point on the face (200) a crown apex setback dimension (412), and the crown apex setback dimension (412) is less than a CG depth distance that is parallel to the crown apex setback dimension (412) and measured from a vertical projection of the center of gravity (CG) on the ground plane (GP) to a vertical projection of the forwardmost point on the face (200) on the ground plane (GP); and (vii) the crown apex (410) is located between the toe (118) and a vertical front-to-back plane through the center of gravity (CG);

D) the high volume aerodynamic golf club head (100) has:

(i) a first moment of inertia (MOIy) about a vertical axis through a center of gravity (CG) of the high volume aerodynamic golf club head (100) that is at least 4000 $g*cm^2$; and (ii) a second moment of inertia (MOIx) about a horizontal axis through the center of gravity (CG) that is at least 2000 $g*cm^2$.

16. The high volume aerodynamic golf club head (100) of claim 15, wherein the apex-to-front radius of curvature (Ra-f) of a portion of the fiber composite material crown portion between the crown apex (410) and the face (200) is at least 25% less than the greatest apex-to-rear radius of curvature (Ra-r), and the crown apex setback dimension (412) is less than 1.75 inches.

17. The high volume aerodynamic golf club head (100) of claim 15, wherein the apex-to-front radius of curvature (Ra-f) of a portion of the fiber composite material crown portion between the crown apex (410) and the face (200) is less than 3 inches.

18. The high volume aerodynamic golf club head (100) of claim 15, wherein the heel-to-toe radius of curvature (Rh-t) of a portion of the fiber composite material crown portion located above the elevation of the maximum top edge height (TEH) is less than 4 inches.

19. The high volume aerodynamic golf club head (100) of claim 18, wherein the apex-to-front radius of curvature (Ra-f) in contact with the crown apex (410) is less than a heel-to-toe radius of curvature (Rh-t) in contact with the crown apex (410).

20. The high volume aerodynamic golf club head (100) of claim 19, wherein an apex ratio of the apex height (AH) to the greatest top edge height (TEH) is at least 1.13.

21. The high volume aerodynamic golf club head (100) of claim 19, wherein the apex-to-front radius of curvature (Ra-f) at the crown apex (410) is less than 3 inches.

22. The high volume aerodynamic golf club head (100) of claim 15, wherein the body (100) is formed of a plurality of individual pieces, and at least one of the individual pieces is formed of aluminum alloy.

23. The high volume aerodynamic golf club head (100) of claim 22, wherein the face (200) includes a nonmetallic face portion, the nonmetallic face portion is adhesively attached to the at least one aluminum alloy component, and the front-to-back dimension (FB) is at least 4.6 inches.

24. The high volume aerodynamic golf club head (100) of claim 22, wherein the face (200) includes a titanium alloy face portion.

25. The high volume aerodynamic golf club head (100) of claim 24, wherein the titanium alloy face portion is adhesively attached to the at least one aluminum alloy component.

26. The high volume aerodynamic golf club head (100) of claim 22, wherein the front-to-back dimension (FB) is at least 4.75 inches.

27. A high volume aerodynamic golf club head (100) comprising:

A) a body (110) having a club head volume of at least 400 cc, a face (200), a sole section (300), a crown section (400), a front (112), a back (114), a heel (116), a toe (118), and a center of gravity (CG), wherein the body (110) has a front-to-back dimension (FB) of at least 4.4 inches, and the body (100) is formed of a plurality of individual pieces, and at least one of the individual pieces is formed of aluminum alloy;

B) the face (200) having a top edge (210) and a lower edge (220), wherein a top edge height (TEH) is the elevation of the top edge (210) above a ground plane (GP), and a lower edge height (LEH) is the elevation of the lower edge (220) above the ground plane (GP), wherein a maximum top edge height (TEH) is at least 2 inches; and C) the crown section (400) having a crown apex (410) located an apex height (AH) above a ground plane (GP), wherein:

(i) within a front-to-back vertical section through the crown apex (410) and perpendicular to a vertical plane created by a shaft axis (SA), a portion of the crown section (400) between the crown apex (410) and the face (200) has an apex-to-front radius of curvature (Ra-f);

(ii) within a heel-to-toe vertical section parallel to the vertical plane created by the shaft axis (SA), a portion of the crown section (400), above the elevation of the maximum top edge height (TEH), has a heel-to-toe radius of curvature (Rh-t), and the heel-to-toe radius of curvature (Rh-t) in contact with the crown apex (410) is less than 4 inches;

(iii) within the front-to-back vertical section a portion of the crown section (400), above the elevation of the maximum top edge height (TEH), between the crown apex (410) and the back (114) has an apex-to-rear radius of curvature (Ra-r);

(iv) wherein the apex-to-front radius of curvature (Ra-f) at the crown apex (410) is less than the greatest apex-to-rear radius of curvature (Ra-r) of the portion of the crown section (400) within the front-to-back vertical section and located above the elevation of the maximum top edge height (TEH);

(v) the crown apex (410) is located at a crown apex HT dimension (414) that is greater than 30% of the heel-to-toe dimension (HT) and less than 70% of the heel-to-toe dimension (HT);

(vi) the crown apex (410) is behind the forwardmost point on the face (200) a crown apex setback dimension (412), and the crown apex setback dimension (412) is less than a CG depth distance that is parallel to the crown apex setback dimension (412) and measured from a vertical projection of the center of gravity (CG) on the ground plane (GP) to a vertical projection of the forwardmost point on the face (200) on the ground plane (GP); and (vii) the crown apex (410) is located between the toe (118) and a vertical front-to-back plane through the center of gravity (CG);

D) the high volume aerodynamic golf club head (100) has:

(i) a first moment of inertia (MOIy) about a vertical axis through a center of gravity (CG) of the high volume aerodynamic golf club head (100) that is at least 4000 g*cm$^2$; and (ii) a second moment of inertia (MOIx) about a horizontal axis through the center of gravity (CG) that is at least 2000 g*cm$^2$.

28. The high volume aerodynamic golf club head (100) of claim 27, wherein the apex-to-front radius of curvature (Ra-f) of a portion of the crown section (400) between the crown apex (410) and the face (200) is less than 3 inches, and the crown apex setback dimension (412) is less than 1.75 inches.

29. The high volume aerodynamic golf club head (100) of claim 28, wherein the apex-to-front radius of curvature (Ra-f) of a portion of the crown section (400) between the crown apex (410) and the face (200) is at least 25% less than the greatest apex-to-rear radius of curvature (Ra-r).

30. The high volume aerodynamic golf club head (100) of claim 29, wherein the front-to-back dimension (FB) is at least 4.6 inches, and the face (200) includes a titanium alloy face portion adhesively attached to the at least one aluminum alloy component.

31. The high volume aerodynamic golf club head (100) of claim 30, wherein the crown section (400) includes a fiber composite material crown portion adhesively attached to the at least one aluminum alloy component.

32. The high volume aerodynamic golf club head (100) of claim 30, wherein the apex-to-front radius of curvature (Ra-f) in contact with the crown apex (410) is less than a heel-to-toe radius of curvature (Rh-t) in contact with the crown apex (410).

33. The high volume aerodynamic golf club head (100) of claim 30, wherein an apex ratio of the apex height (AH) to the greatest top edge height (TEH) is at least 1.13, and the club head volume is at least 440 cc.

34. The high volume aerodynamic golf club head (100) of claim 30, wherein the front-to-back dimension (FB) is at least 4.75 inches.

* * * * *